US008293447B2

(12) United States Patent
Yamazaki et al.

(10) Patent No.: US 8,293,447 B2
(45) Date of Patent: Oct. 23, 2012

(54) TONER

(75) Inventors: Katsuhisa Yamazaki, Numazu (JP); Masami Fujimoto, Sunto-gun (JP); Masaaki Taya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/166,673

(22) Filed: Jun. 22, 2011

(65) Prior Publication Data

US 2011/0256480 A1 Oct. 20, 2011

Related U.S. Application Data

(62) Division of application No. 10/956,051, filed on Oct. 4, 2004.

(30) Foreign Application Priority Data

Oct. 6, 2003 (JP) ..... 2003-346896

(51) Int. Cl.
*G03G 9/087* (2006.01)

(52) U.S. Cl. ..... 430/137.15; 430/137.18; 430/137.2

(58) Field of Classification Search ..... 430/137.15, 430/137.18, 137.2
See application file for complete search history.

(56) References Cited

U.S. PATENT DOCUMENTS

| | | | | |
|---|---|---|---|---|
| 5,912,101 | A | 6/1999 | Karaki et al. | |
| 6,235,441 | B1 * | 5/2001 | Tanikawa et al. | 430/108.21 |
| 6,379,855 | B1 | 4/2002 | Hayashi et al. | |
| 6,610,454 | B2 | 8/2003 | Hashimoto et al. | |
| 6,632,577 | B2 | 10/2003 | Akashi et al. | |
| 6,670,087 | B2 | 12/2003 | Fujikawa et al. | |
| 6,689,525 | B2 | 2/2004 | Itabashi | |
| 6,808,855 | B2 | 10/2004 | Ayaki et al. | |
| 7,147,980 | B2 | 12/2006 | Itakura et al. | |
| 7,147,981 | B2 | 12/2006 | Fujikawa et al. | |
| 7,288,354 | B2 | 10/2007 | Moribe et al. | |
| 2002/0022189 | A1 | 2/2002 | Kawanishi et al. | |
| 2002/0098431 | A1 * | 7/2002 | Fujikawa et al. | 430/106.2 |
| 2003/0054275 | A1 | 3/2003 | Sugimoto et al. | |
| 2006/0141380 | A1 * | 6/2006 | Yamazaki et al. | 430/109.2 |

FOREIGN PATENT DOCUMENTS

| | | | |
|---|---|---|---|
| EP | 0 393 592 | A2 | 10/1990 |
| EP | 1 462 860 | A2 | 9/2004 |
| JP | 04-191864 | A | 7/1992 |
| JP | 06-308759 | | 11/1994 |
| JP | 10-087837 | | 4/1998 |
| JP | 10087837 | * | 4/1998 |
| JP | 10-142836 | A | 5/1998 |
| JP | 10-339966 | A | 12/1998 |
| JP | 11-202557 | A | 7/1999 |
| JP | 2000-235279 | | 8/2000 |
| JP | 2001-188383 | A | 7/2001 |
| JP | 2002-351143 | A | 12/2002 |
| JP | 2003-241427 | A | 8/2003 |

OTHER PUBLICATIONS

Machine English language translation of JP-1 0087837 Apr. 1998.*
Official Action dated Oct. 11, 2011 in European Application No. 04 023 714.1.
Japanese Office Action dated Sep. 8, 2009 counterpart application No. 2004-292292 (Partial English language translation)—10 pages.
European Office Action dated Mar. 21, 2012 in European Application No. 04 023 714.1.

* cited by examiner

*Primary Examiner* — Hoa V Le
(74) *Attorney, Agent, or Firm* — Fitzpatrick, Cella, Harper & Scinto

(57) ABSTRACT

An object of the present invention is to provide a toner which allows fixation at low temperatures, which is excellent in anti-offset ability, and which provides a high quality image at high and low humidities in a stable manner without causing any image defect over time. Provided is a toner, containing at least a binder resin and a colorant in which: the binder resin in the toner contains 60% by mass or more of a styrene/acryl resin and a THF-insoluble fraction A which is an extraction residue obtained by carrying out Soxhlet extraction with tetrahydrofuran (THF) for 16 hours; the THF-insoluble fraction A contains a TOL-insoluble fraction B which is an extraction residue obtained by carrying out Soxhlet extraction with toluene (TOL) for 16 hours; and a mass ratio (B/A) between the THF-insoluble fraction A and the TOL-insoluble fraction B is in the range of $0.1 \leqq B/A \leqq 0.5$.

1 Claim, No Drawings

TONER

This application is a divisional of Application No. 10/956,051, filed Oct. 4, 2004, the contents of which are incorporated herein by reference.

FIELD OF THE INVENTION

The present invention relates to a developer (toner) for use in an image forming method such as an electrophotographic method, an electrostatic-recording method, or a toner jet method.

DESCRIPTION OF THE RELATED ART

Conventionally, various methods including an electrostatic-recording method, a magnetic recording method, and a toner jet method have been known as an image forming method in the art. In addition, various methods described in publications such as U.S. Pat. No. 2,297,691, JP 42-23910 B, and JP 43-29784 B have been known as an electrophotographic method. Generally, a photoconductive substance is used and an electric latent image is formed on a photosensitive member by any of various means. The latent image is developed with a toner and converted into a visible image. If required, the toner is transferred to a transferring material such as paper and the toner image is then fixed on the transferring material under heat, pressure, or the like. The residual toner on the photosensitive member, which fails transferring, is removed by any of various methods. Subsequently, those steps are repeated.

For the above process, in recent years, smaller and lighter copying machines with higher process speed and reliability have been severely demanded. For instance, such a copying machine is provided not only just as one for paperwork, which is commonly used for copying an original, but also as a digital printer used as an output of a computer or as one for copying an image in a high definition such as graphic design. Besides, such a copying machine comes into use for near-print (print-on-demand purposes for allowing limited printing of a wide variety of products with a personal computer from text editing and copying to bookbinding) that requires more reliability. Therefore, an image with higher definition and higher image quality has been demanded and, as a result, and higher performance has been also demanded for a toner.

By the way, fixing ability is one of the important characteristic features among those required of a toner used in a digital printer and in copying an image with a high definition.

For the fixing, various methods and devices have been developed. Among them, at the present, the most popular method is a thermal pressure fixing method with a heat roller.

The thermal pressure fixing method with a heat roller involves the fixation of a toner image on a fixing sheet on which a toner is to be fixed such that the sheet passes over the surface of a heat roller formed of a material having a mold-release characteristic while the toner image surface of the sheet is kept in contact with the surface of the heat roller. In this method, the surface of the heat roller and the toner image of the fixing sheet are brought into contact with each other under pressure, so that heat efficiency at the time of melting and fixing the toner image on the fixing sheet can be extremely excellent and allow quick fixation. Therefore, such a method will be very effective in a high-speed electrophotographic copying machine. In the above method, however, part of the toner image may adhere and transfer to the surface of the fixing roller to contaminate the next fixing sheet (i.e., offset phenomenon) because the toner image is being molten when it is brought into contact with the surface of the heat roller under pressure. Preventing the toner from adhering to the surface of the heat fixing roller is one of the essential requirements of the heat roller fixation method.

Recently, furthermore, a fixing device that includes a pressure member and a heating member instead of the heat roller has been applied in practical use, having an advantage in heat efficiency. The pressure member and the heating member are faced to and in contact with each other and the pressure member brings a recording material into close contact with the heating member through a film. The offset phenomenon more easily occurs because the surface of the toner is melted and the need for preventing such a phenomenon increases.

Also, in a fixing process, in order to realize the fixing method with a short weighting time and a low consumption current, the toner should be designed to realize fixation at lower temperatures.

For preventing the offset phenomenon, many proposals for a system added with a cross-linking agent have been proposed. For example, JP 51-23354 proposes a toner that contains a suitably cross-linked vinyl polymer with the addition of a cross-linking agent and a molecular weight modifier. Also, JP 55-6805 B proposes a toner containing an $\alpha,\beta$-unsaturated ethylene monomer as a structural unit with a wide molecular weight distribution such that a ratio between a weight average molecular weight and a number average molecular weight is in the range of 3.5 to 4.0. As compared with a toner made of a single resin having a narrow molecular weight distribution, each of the aforementioned toners has a broader range of possible fixing temperatures between the lowest fixing temperature (the lower limit of temperature at which a toner can be fixed) and an offset temperature (the temperature at which a toner begins to generate an offset phenomenon). However, a fixing temperature cannot be lowered sufficiently when the offset preventing ability is satisfied. In contrast, the offset preventing ability becomes inadequate when the low-temperature fixing ability is satisfied.

For this reason, JP 57-208559 A proposes a toner in which a polyester resin is subjected to cross-linking in place of the vinyl resin and added with an offset preventing agent as a polyester resin is supposed to be essentially more excellent than the vinyl resin in respect of low-temperature fixing ability. However, this toner has a problem in its productivity (grindability) even though the toner is excellent in both the low-temperature fixing ability and offset preventing ability. JP 56-116043 A also proposes a toner made of a resin prepared by polymerizing a vinyl monomer in the presence of a reactive polyester resin, where the polymerization is performed through a cross-linking reaction, addition reaction, and graft reaction.

The toner that contains a cross-linked vinyl polymer as described above or a gel fraction is surely advantageous in improvement of anti-offset property.

However, when the toner is prepared using such a cross-linked vinyl polymer as a raw material, a large shearing force will be applied to the polymer because friction extremely increases inside the polymer at the time of melt-kneading for toner production. For this reason, the molecular chain of the polymer will be broken to cause a decrease in melt viscosity of the polymer. Therefore, the offset ability of the toner may be adversely affected For solving those problems, each of JP 55-90509 A, JP 57-178249 A, JP 57-178250 A, JP 60-4946 A, and so on proposes a toner prepared by using a resin having a carboxylic acid and a metal compound as raw materials for the toner and subjecting these components to a thermal reaction at the time of melt kneading to form a cross-linked polymer. Furthermore, each of JP 63-214760 A, JP 63-217362 A, JP 63-217363 A, and so on proposes a toner prepared by reacting a vinyl resin containing a vinyl polymer and a specific half-ester compound as essential structural units with a polyvalent metal compound to provide a cross-linkage. However, in each of the cases using the cross-linking agents, a further improvement will be required for satisfying both anti-offset ability and low-temperature fixing ability.

Furthermore, JP 06-011890 A, JP 06-222612 A, JP 09-318140 A, JP 10-087837 A, JP 10-090943 A, JP 2001-188383 A, JP 2003-015363 A, and so on each propose that a binder resin including a resin containing a carboxyl group and a resin containing a glycidyl group is subjected to the control of its molecular weight distribution and acid value, and the amount of the resin present therein to substantially improve a balance among the fixing ability, anti-offset ability, and anti-blocking ability of the toner. Furthermore, JP 2002-189316 proposes that the fixing ability, anti-offset ability, anti-blocking ability, grindability, and durable developing ability of the toner can be improved by controlling the storage elastic modulus of the resin at a certain range of temperatures. Those proposals produce improvements in the anti-offset ability and anti-blocking ability of the toner but the developing ability thereof is still insufficient.

Therefore, the toner still has room for an improvement in consideration of the use of the toner in the field of near-print or the like that requires higher reliability. Likewise, the fixing ability of the toner is also still insufficient in a high-speed copying system which has been required in recent years and a machine on which a fixing process with lower power consumption is realized. More concretely, the time required for allowing a recording medium to pass through a fixing apparatus is shortened as the speed of an image-transfer increases even though the heating temperature and applied pressure at the time of fixing are almost the same as those of the conventional one.

In other words, the total amount of heat (work load) applied on the recording medium tends to decrease, so that the toner will require a further improvement in its fixing ability.

The proposals described above are able to attain improvements in fixing ability and offset ability of the toner but they still have room for improvements for attaining downsizing, weight-saving, speeding-up, and obtaining high reliability.

SUMMARY OF THE INVENTION

The present invention has been accomplished under those circumstances and intends to provide a color toner to solve the problems described above.

More specifically, an object of the present invention is to provide a toner which can be fixed at low temperatures and has an excellent anti-offset ability, allowing the formation of a high-quality image stably without causing any image defect over time even if the toner is used at high and low humidities.

Another object of the present invention is to provide a toner having good productivity.

As a result of repeating intensive studies, the inventors of the present invention have found out that the above problems can be solved with the following configuration.

That is, the present invention is as follows.

(1) A toner, containing at least a binder resin and a colorant, in which:

(i) the binder resin in the toner contains 60% by mass or more of a styrene/acryl resin;

(ii) the binder resin in the toner contains a THF-insoluble fraction A which is an extraction residue obtained by carrying out Soxhlet extraction with tetrahydrofuran (THF) for 16 hours;

(iii) the THF-insoluble fraction A contains a TOL-insoluble fraction B which is an extraction residue obtained by carrying out Soxhlet extraction with toluene (TOL) for 16 hours; and (iv) a mass ratio (B/A) between the THF-insoluble fraction A and the TOL-insoluble fraction B is in the range of $0.1 \leqq B/A \leqq 0.5$.

(2) A toner as described in the item (1), in which a content of the THF-insoluble fraction A is 10% by mass to 50% by mass on the basis of a content of the binder resin in the toner.

(3) A toner as described in the item (1) or (2), in which a THF-soluble fraction of the binder resin in the toner has at least one peak in a region of molecular weights of 3,000 to 30,000 of a molecular weight distribution measured by gel-permeation chromatography (GPO), and an area of a region of molecular weights of 100,000 or less accounts for 70 to 100% of a whole area.

(4) A toner as described in any one of the items (1), to (3), in which a TOL-soluble fraction obtained by extraction with TOL of the THF-insoluble fraction A has at least one peak in a region of molecular weights of 3,000 to 30,000 of a molecular weight distribution measured by gel-permeation chromatography (GPO), and an area of a region of molecular weights of 100,000 or less accounts for 60 to 90% of a whole area in a GPC chart.

(5) A toner as described in any one of the items (1) to (4), in which the styrene/acryl resin in the binder resin of the toner is obtained by making a reaction between a carboxyl group-containing vinyl resin and a glycidyl group-containing vinyl resin.

(6) A toner as described in the item (5), in which a THF-insoluble fraction C which is an extraction residue obtained by carrying out Soxhlet extraction with tetrahydrofuran (THF) for 16 hours with respect to the styrene/acryl resin in the binder resin of the toner is 0% by mass to 10% by mass.

(7) A toner as described in any one of the items (1) to (6), in which a maximum endothermic peak is found in a temperature range of 60 to 120° C. in an endothermic curve in differential thermal analysis (DSC) on the toner.

(8) A toner as described in any one of the items (1) to (7), in which the colorant is a magnetic iron oxide particle having an octahedral form and/or a magnetic iron oxide fine particle having a plural nuclei form.

(9) A toner as described in the item (8), in which a content of the magnetic iron oxide particle is 20 to 200 parts by mass with respect to 100 parts by mass of the binder resin.

DETAILED DESCRIPTION OF THE INVENTION

Hereinafter, the invention will be described in detail.

According to the present invention, there is provided a toner containing at least a binder resin and a colorant in which: the binder resin in the toner contains 60% by mass or more of a styrene/acryl resin and a THF-insoluble fraction A which is an extraction residue obtained by carrying out Soxhlet extraction with tetrahydrofuran (THF) for 16 hours; the THF-insoluble fraction A contains a TOL-insoluble fraction B which is an extraction residue obtained by carrying out Soxhlet extraction with toluene (TOL); and a mass ratio between the THF-insoluble fraction A and the TOL-insoluble fraction B is $0.1 \leqq B/A \leqq 0.5$.

The inventors of the present invention have advanced their investigation on the constituent materials used in a toner, and they have found out the fact that a toner, which has sufficient fixing ability, anti-offset ability, grindability, and so on in addition to its resistance to a mechanical share and ability of forming an image without causing any image defect over time, is prepared by controlling a ratio between the amount of an insoluble fraction obtained by extraction with a specific solvent in the toner and the amount of another insoluble fraction obtained by a re-extraction of the former insoluble fraction with a different solvent, and preferably by controlling the molecular weight of an extracted insoluble fraction.

The fact that the THF-insoluble fraction is present in the binder resin in the toner and a certain proportion of the insoluble fraction is extracted with TOL to cause another insoluble fraction may be explained as follows. The THF and TOL have their respective solubility parameters of 18.6 and 18.2 ($J^{0.5}m^{-1.5}$) and thus no difference in dissolved amounts of the constituent components may be caused with a solvating action. In other words, the presence of a TOL-soluble fraction extracted with TOL in the THF-insoluble fraction may cause a difference in amounts of the components solved as a result of a difference in temperatures at the time of extraction (i.e., the boiling point of THF is about 65° C. and the boiling point of TOL is about 110° C.). Namely, in the THF-insoluble fraction, entangled molecules do not unravel at the time of the extraction with THF. On the other hand, in the extraction with TOL, as the entangled molecules unravel, the presence of a component that becomes a soluble one is shown. In other words, such a component is also represented as a component having a molecular state to be changed by variations in temperature from 65° C. to 110° C.

The binder resin in the toner of the present invention can be classified into two components at first as follows:

<1> THF16: a component soluble in THF, obtained by extraction (16-hour extraction); and <2> THF-insoluble fraction A: a component insoluble in THF, obtained by extraction (16-hour extraction).

The component <2> can be further classified into two components as follows:

<2-1> TOL16: a component soluble in TOL, obtained at the time of further extracting the THF-insoluble fraction A with TOL (16-hour extraction); and <2-2> TOL-insoluble fraction B: a component insoluble in TOL, obtained at the time of further extracting the THF-insoluble fraction A with TOL (16-hour extraction).

As used herein, the "THF16" is a component effective for fixation at low temperatures. Therefore, if there is no desired amount of the component present, the toner will be hardly provided with sufficient fixing ability. The "THF-insoluble fraction A" is a component effective in expressing good mold release characteristics from a heating member such as a fixing roller. In particular, when the fraction is applied to a high-speed machine, there is an effect of reducing the offset amount of the toner to a heating member such as a fixing roller. The "TOL16" in the THF-insoluble fraction A is a component formed of entangled molecules as described above and exerts a specific action in the toner. That is, the "TOL16" tends to behave thermodynamically in a low temperature region because the molecular weight distribution of the "TOL16" approximates that of a low-molecular-weight resin. Furthermore, the "TOL16" is also excellent in solubility under heat and is a component capable of having suitable elasticity as a result of entanglement of molecules and also capable of satisfying an anti-offset ability at high temperatures without spoiling the low-temperature fixing ability. Furthermore, the "TOL16" is also excellent in grindability because the "TOL16" has no strong brittleness unlike the conventional insoluble hard fraction. In addition, the role of "TOL16" takes a middle position between the "THF16" and the "TOL-insoluble fraction B", so that the "TOL16" can be a composition capable of increasing the compatibility of each of them. As a result, the "TOL16" further increases the dispersibility of a colorant, mold releasing agent, or the like used as a raw material of the toner, thereby improving the durable developing ability of the toner.

The "TOL-insoluble fraction B" in the "THF-insoluble fraction A" is a high cross-linking component having strong brittleness, so that it can be a component excellent in thermal stability. Therefore, a small amount of the "TOL-insoluble fraction B" present in the toner will allow the toner to be provided with a strong mechanical share and to retain an image with a high quality for a long period of time.

Then, for obtaining a toner having a wide fixing region and providing a stable image quality without causing any image defect over time, taking into consideration of the characteristics of the above respective components, the present invention defines a ratio between the amount of an insoluble fraction obtained by extraction with THF in a binder resin of a toner and the amount of an insoluble fraction obtained by extracting the former insoluble fraction with TOL again.

That is, for the toner of the present invention, the content of a THF-insoluble fraction A, which is an extraction residue obtained by carrying out Soxhlet extraction with tetrahydrofuran (THF) of the binder resin for 16 hours, is represented by "A". The content of a TOL-insoluble fraction B, which is an extraction residue obtained by carrying out Soxhlet extraction with toluene (TOL) of the THF-insoluble fraction A for 16 hours, is represented by "B". Then, the mass ratio of B/A satisfies $0.1 \leqq B/A \leqq 0.5$, more preferably $0.15 \leqq B/A \leqq 0.35$. If the mass ratio B/A between the THF-insoluble fraction A and the TOL-insoluble fraction B is less than 0.1, the THF-insoluble fraction B hardly exists and almost all tangles come loose at the boiling point of TOL. When there is no high cross-linking component excellent in thermal stability, the mechanical share becomes weakened and the deterioration of the toner tends to be accelerated. As a result, it becomes difficult to retain image quality in a stable manner for a long period of time. It is also difficult to provide a kneading share at the time of a melt kneading step in the production of toner particles. Therefore, the dispersibility of a raw material such as a mold release agent, a magnetic body, or a charge control agent in the toner particles reduces, whereby the developing ability of the toner will be affected. Furthermore, if the mass ratio B/A between the THF-insoluble fraction A and the TOL-insoluble fraction B is less than 0.1, very rare of component of flexibility and viscous caused by the entanglement of molecules, is going to exist in the toner. Thus, the adhesive property of the toner to a transfer material becomes weakened and it is bearable to grinding. However, the toner becomes weakened against peeling. In particular, the toner tends to exfoliate from a transparency (transparent sheet).

On the other hand, if the mass ratio B/A between the THF-insoluble fraction A and the TOL-insoluble fraction B exceeds 0.5, the existing amount of the "TOL16", which is a component generated by the entanglement of molecules, decreases while the existing amount of the TOL-insoluble fraction B", which is a high cross-linking component, increases. As the molecular weight distribution of the "TOL16" is proximate to that of a low-molecular-weight resin, the existing amount of the "TOL16", which will tend to cause a thermal behavior in a low temperature region, decreases. Thus, the fixing ability of the toner will deteriorate against a half tone image and a carton. Moreover, it becomes difficult to compatibilize between the low molecular component and the high cross-linking component, so that an improvement in dispersibility of the colorant, mold release agent, or the like will become impossible. As a result, the durable developing ability of the toner at high temperature under high humidity becomes worse. Furthermore, if the existing amount of the "TOL-insoluble fraction B" increases, the amount of a component having strong brittleness increases. As a result, the grindability is affected. In addition, the anti-high-temperature offset ability decreases as a molecular breakage is accelerated at the time of kneading.

Furthermore, the amount of the above THF-insoluble fraction A in the toner of the present invention is 10 to 50% by mass, preferably 20 to 50% by mass, more preferably 25 to 50% by mass. The THF-insoluble fraction A is a component effective in exerting good mold-release characteristics to a heating member such as a fixing roller. When the fraction is applied to a high-speed machine, there is an effect of reducing the offset amount of the toner against a heating member such as a fixing roller. When the amount of the THF-insoluble fraction A is less than 10% by mass, the above effect is hardly expressed. If the amount of the THF-insoluble fraction A exceeds 50% by mass, the fixing ability of the toner decreases and the dispersibility of a raw material in the toner also decreases, causing uneven electrostatic charge property of the toner.

Furthermore, in the toner of the present invention, the above "THF16" shows at least one peak in a region of molecular weights of 3,000 to 30,000 in a molecular weight distribution by GPO. Alternatively, in the chart of the GPO, the total area of the region corresponding to molecular weights of 100,000 or less may account for 70 to 100% of the total area of the whole. The toner attains good low-temperature fixing ability and anti-blocking ability by having at least one peak in the region of molecular weights of 3,000 to 30,000. If the peak is observed at a molecular weight of less than 3,000, the anti-blocking ability of the toner decreases. On the other hand, if the peak is observed at a molecular weight of more than 30,000, it becomes difficult to obtain a sufficient fixing ability of the toner. Furthermore, if the total area of molecular weights of 100,000 or less accounts for less than 70% with respect to the total area of the whole, it becomes difficult to attain a sufficient fixing ability of the toner.

Furthermore, in the toner of the present invention, a TOL-soluble fraction "TOL16", which is obtained by extraction of the above THF-insoluble fraction A with TOL, has at least one peak in the region of molecular weights of 3,000 to 30,000 in a molecular distribution with GPC. Here, in the chart of the GPC, the total area of the region of molecular weights of 100,000 or less may account for 60 to 90% with respect to the total area of the whole. If the molecular weight distribution of the TOL-soluble fraction is in the above region, it is proximate to the molecular weight distribution of a low-molecular-weight resin and thus the toner tends to cause a thermal behavior in a low temperature region. Furthermore, the toner is also excellent in thermal solubility. Besides, the toner is allowed to satisfy suitable elasticity by entanglement of the molecules. Therefore, it becomes possible to satisfy the anti-high-temperature offset ability of the toner without loss of low-temperature fixing ability. Furthermore, as the toner does not have strong brittleness, it also excels in grindability without causing a large amount of fine particles. Furthermore, it also becomes possible to improve the compatibility between the low molecular component and the high cross-linking component. Consequently, the dispersibility of the colorant, mold release agent, or the like used as a raw material of the toner can be further improved to make the durable developing ability of the toner better. Furthermore, an improvement of dispersibility makes the charging characteristics of the toner uniform, so that an image quality such as dot reproductivity will be improved. If the peak is observed at a molecular weight of less than 3,000, the anti-blocking ability of the toner decreases. If the peak is observed at a molecular weight of more than 30,000, the fixing ability of the toner against a halftone image or carton decreases. Alternatively, the total area of a region of molecular weights of less than 100,000 accounts for less than 60% of the total area of the whole, it becomes difficult to compatibilize between the low molecular component and the high cross-linking component. Therefore, it becomes difficult to improve the dispersibility of the colorant, mold release agent, or the like. As a result, the durable developing ability of the toner decreases at high temperature and humidity. In addition, as the amount of the component having stronger brittleness increases, the grindability of the toner is subjected to undesired effects. Moreover, the anti-high-temperature offset ability of the toner decreases as the molecular breakage at the time of kneading is accelerated. If the total area exceeds 90%, the toner tends to peel off from transparent paper.

In the present invention, the binder resin contains 60% by mass or more of a styrene/acryl resin. In the present invention, a false cross-linking component is generated by the entanglement of molecules. Thus, a styrene/acryl resin in the above binder resin may be generated by making a reaction between a carboxyl group-containing vinyl resin and a glycidyl group-containing vinyl resin.

Here, in the glycidyl group-containing vinyl resin, the glycidyl group prompts a ring-opening addition reaction with the carboxyl group in the carboxyl group-containing vinyl resin to form a cross-linking structure. In this case, if the distance between the cross-linking points increases, it becomes possible to control the structure of cross linkage not in a network structure but in a branch structure.

In addition, for obtaining a carboxyl group-containing vinyl resin, the carboxyl group-containing vinyl resin may be constructed of a low-molecular-weight resin component and a high-molecular-weight resin component. The peak molecular weight (MpL) of the low-molecular-weight resin component is preferably in the range of 4,000 to 30,000 for attaining good fixing ability and anti-blocking ability of the toner. The peak molecular weight (MpH) of the high-molecular-weight resin component is preferably in the range of 100,000 to 400,000 for attaining good offset ability and durability of the toner. The acid value of the carboxyl group-containing vinyl resin is preferably 0.5 mg to 50 mgKOH/g. If the acid value is less than 0.5 mgKOH/g, the number of cross-linking portions between the carboxyl group and the glycidyl group decreases, so that the generation of an entangled compound will become difficult. If the acid value exceeds 50 mgKOH/g, in the case of a positively-charged electrostatic toner, there is a tendency that the negative electrostatic property of the binder resin in toner particles increases and thus an image density decreases while fogging increases. In addition, it is preferable to design the toner such that the acid value of the high-molecular-weight resin compound is high, while the acid value of the low-molecular-weight resin component is low. The design causes a selective reaction with a high-molecular-weight resin component to improve the anti-offset ability without causing any undesired effect on the low-temperature fixing ability. The glass transition temperature (Tg) of the vinyl group containing the carboxyl group may be 40 to 70° C. If Tg is less than 40° C., the anti-blocking ability of the toner decreases. On the other hand, if Tg exceeds 70° C., the fixing ability of the toner decreases.

To obtain the above-mentioned carboxyl group-containing vinyl resins, a monomer of a vinyl polymer as follows can be used with a high-molecular-weight resin component and a low-molecular-weight resin component. Monomers each having a carboxyl group include: maleic acid, citraconic acid, dimethyl maleate, itaconic acid, alkenylsuccinic acid, and anhydrides thereof; unsaturated dibasic acids such as fumaric acid, metaconic acid, and dimethyl fumarate, anhydrous monomers thereof, and monoesters of the above-mentioned dibasic acids; α,β-unsaturated acids such as acrylic acid, methacrylic acid, crotonic acid, and cinnamic acid, and anhydride thereof, anhydrides of the above-mentioned α,β-unsaturated acids, and anhydrides with lower aliphatic acids; anhydrous monomers thereof; and alkenylmalonic acid, alkenylglutaric acid; and alkenyladipic acid, and anhydrides thereof and monoesters thereof. Of those, maleic acid, maleic acid half ester, and maleic anhydride are used as preferred monomer to obtain carboxyl group-containing vinyl resins of the prevention. Further, a comonomer used in combination with a carboxyl group-containing vinyl monomer will be described below. At least one of the vinyl monomers including: styrene and styrene derivatives such as styrene, o-methylstyrene, m-methylstyrene, p-methylstyrene, p-methoxystyrene, p-phenylstyrene, p-chlorstyrene, 3,4-dichlorstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; α-methyl aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chlorethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide; and the above-mentioned α,β-unsaturated acid esters, and dibasic diesters, may be used.

Of those, monomers are preferably combined to provide either of a styrene copolymer or a styrene-acrylic copolymer. The styrene copolymer is preferable because an entanglement compound is efficiently formed by making an interaction of the carboxyl groups existing in some places on the polymer chain of the styrene copolymer with the glycidyl group of the glycidyl group-containing vinyl resin.

Further, if required, the binder resin used in the present invention may contain a polymer cross-linked with a cross-linking monomer shown below. A monomer having two or more polymerizable double bonds is mainly used as the cross-linking monomer. Examples of the cross-linking monomers include: aromatic divinyl compounds such as divinylbenzene and divinylnaphthalene; diacrylate compounds bonded together with alkyl chains such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and those obtained by changing the "acrylate" of the above-mentioned compounds to "methacrylate"; diacrylate compounds bonded together with alkyl chains each containing an ether bond such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and those obtained by changing the "acrylate" of the above-mentioned compounds to "methacrylate"; diacrylate compounds bonded together with chains each containing an aromatic group and an ether bond such as polyoxyethylene (2)-2,2-bis(4-hydroxyphenyl)propane diacrylate and polyoxyethylene(4)-2,2-bis(4-hydroxyphenyl)propane diacrylate, and those obtained by changing the "acrylate" of the above-mentioned compounds to "methacrylate"; and polyester-type diacrylate compounds such as MANDA (trade name, manufactured by Nippon Kayaku Co., Ltd.). Examples of the polyfunctional cross-linking agent include: pentaerythritol acrylate, trimethylolethane triacrylate, trimethylolpropane triacrylate, tetramethylolmethane tetraacrylate, oligoester acrylate, and those obtained by changing the "acrylate" of the above-mentioned compounds to "methacrylate"; and triallyl cyanurate and triallyl trimellitate.

Each of those cross-linking monomers is preferably used in an amount of 0.01 to 5% by mass (more preferably about 0.03 to 3% by mass) with respect to 100% by mass of another monomer component.

For producing the resins used in the present invention, such as the carboxyl group-containing vinyl resin or the glycidyl group-containing vinyl resin, or the like, it is necessary to sufficiently take into consideration of conditions including kinds of an initiating agent and a solvent and reaction conditions.

Examples of available initiators include: organic peroxides such as benzoyl peroxide, 1,1-di(t-butylperoxy)-3,5,5-trimethylcyclohexane, n-butyl-4,4-di(t-butylperoxy)valerate, dicumyl peroxide,α,α'-bis(t-butylperoxyisopropyl)benzene, t-butyl peroxycumen, and di-t-butyl peroxide; and azo and diazo compounds such as azobisisobutyronitrile and diazoaminoazobenzene.

A method of producing a low-molecular-weight resin component to be used for the production of a carboxyl group-containing vinyl resin in accordance with the present invention may be any of the methods well known in the art. However, a bulk polymerization is able to provide a low-molecular-weight polymer by carrying out polymerization at high temperature and facilitating a stop reaction velocity. In this case, however, there is a problem in that the reaction is hardly controlled. In contrast, a solution-polymerization method is preferable to obtain a low-molecular-weight resin composition because a low-molecular-weight polymer can be obtained under mild conditions using the difference of radical chain transfer with a solvent or adjusting the amount of an initiator or reaction temperature. The solvents, which can be used in the solution polymerization, include xylene, toluene, cumene, cellosolve acetate, isopropyl alcohol, and benzene.

In particular, when a styrene monomer is used, xylene, toluene, or cumene is preferable. The solvent may be suitably selected depending on the type of polymer to be polymerized. Although a reaction temperature varies depending on a solvent used, a polymerization initiator, and polymers polymerized, it is preferable to carry out the reaction at 70 to 230° C. in general. In the solution polymerization, the reaction may be carried out at a ratio of 300 to 400 parts by mass of a monomer with respect to 100 parts by mass of the solvent. Furthermore, after completion of the polymerization, the polymer may be added with one or more of other polymers.

Examples of a method of synthesizing a high-molecular-weight resin component to be used in the process of producing a carboxyl group-containing vinyl resin in accordance with the present invention include a bulk polymerization method, a solution polymerization method, an emulsion polymerization method, and a suspension polymerization method. Of those, the emulsion polymerization method is a method involving: dispersing a monomer substantially insoluble in water as minute particles in an aqueous phase with an emulsifier; and then carrying out polymerization using a water-soluble polymerization initiator. In this method, it is easy to adjust the degree of a reaction heat and a stop reaction velocity is small because a phase for polymerization (an oily phase constructed of the polymer and monomer) is different from an aqueous phase. In this case, as a result, the polymerization velocity is higher than usual and thus the resin having a higher polymerization degree is obtained. Furthermore, the polymerization process is comparatively simple and easy and a polymerized product is a fine particle. Also, in the production of a toner, a mixture with an additive such as a colorant or a charge control agent is easily prepared. Therefore, the method is preferably used as a method of synthesizing a high-molecular-weight resin component. It is noted that a polymer tends to be impure because of the added emulsifier and any suitable procedure such as a salting out process may be required for collecting the polymer. For avoiding such inconvenience, a suspension polymerization method is preferably used. However, the most desirable method as a method of synthesizing a high-molecular-weight resin component is a solution polymerization method. This is because the solution polymerization method can be carried out under mild conditions, carboxyl groups required for cross-linking can be introduced into the higher-molecular weight component, while the distance between cross-linking points is controlled. Besides, the high-molecular-weight resin component synthesized by the solution polymerization method represents a good compatibility at the time of mixing with the low-molecular-weight resin component. Consequently, the method provides a further improvement in developing ability of the toner and thus the solution polymerization method is preferable.

The styrene/acryl resin in the binder resin of the present invention is preferably obtained by reacting between the carboxyl group-containing vinyl resin and a glycidyl group-containing vinyl resin described below.

A monomer having a glycidyl group unit which composes the glycidyl group-containing vinyl resin is a compound containing vinyl and epoxy groups such as an ester consisting of glycidyl alcohol and unsaturated carboxylic acid, or an unsaturated glycidyl ether. Specific examples thereof include glycidyl acrylate, glycidyl methacrylate, β-methylglycidyl acrylate, β-methylglycidyl methacrylate, acrylglycidyl ether, and allylβ-methylglycidyl ether. A compound represented as a glycidyl monomer by the formula (1) is preferably used.

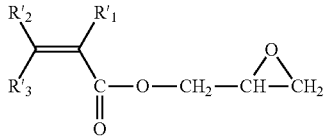

(1)

(wherein $R'_1$, $R'_2$, and $R'_3$ independently represent a hydrogen atom, an alkyl group, an aryl group, an aralkyl group, a carboxyl group, or an alkoxycarbonyl group)

A glycidyl group-containing vinyl resin can be obtained by copolymerizing at least one monomer containing a glycidyl group unit described above with a vinyl monomer by a polymerization method which is known in the art. The glycidyl group-containing vinyl resin has a weight average molecular weight (Mw) of 2,000 to 100,000, preferably 2,000 to 50,000, further preferably 3,000 to 4,000. If Mw is less than 5,000, even though the molecular weight increases in the reaction in the binder resin, there is much breakage of molecule chains in the kneading step and the effects on anti-offset ability decrease. If Mw exceeds 30,000, the fixing ability of the toner may be affected. Furthermore, the epoxy number is preferably 0.01 to 5 eq/kg. If the epoxy number is less than 0.01 eq/kg, the reaction hardly occur and the production of a high-molecular weight component or THF-insoluble fraction is small, so that the effect on anti-offset ability decreases. In addition, if the epoxy number exceeds 5 eq/kg, a cross-linking structure like a mesh is established, while the reaction easily occurs. Therefore, in the kneading step, much breakage of molecule chains occurs while the effect on anti-offset ability decreases.

A glycidyl group-containing vinyl resin may be compounded such that 0.01 to 10 mol, preferably 0.05 to 5 mol of the glycidyl group is included with respect to 1 mol of a carboxyl group in the carboxyl group-containing vinyl resin. If the amount of the glycidyl group is less than 0.01 mol, the amount of the glycidyl group is lower than that of the carboxyl group in the styrene/acryl resin. Thus the number of the cross-linking points decreases and the formation of a cross-linking structure which exerts a sufficient effect on the anti-offset ability even in the case of mixing the glycidyl group-containing vinyl resin in the styrene/acryl resin hardly occurs. Furthermore, a kneading share, which is caused by a cross-linking structure, cannot be applied at the time of melt-kneading in the production of toner particles. Therefore, the dispersibility of a raw material such as a mold release agent, magnetic body, or charge control agent in toner particles decreases, causing a bad influence on the developing ability of the toner. Since the carboxyl group remains in the styrene/acryl resin, the carboxyl group exerts a bad influence on the uniformity or durable stability of the charge. If the amount exceeds 10 mol, the carboxyl group and glycidyl group in the styrene/acryl resin are cross-linked together to provide a cross-liking structure which exerts the effect on the anti-offset ability of the toner. In this case, however, the distance between cross-linking points becomes short to form a cross-linking structure in the form of a net. Therefore, much breakage of molecule chains occurs in the kneading step, reducing the effect on the anti-offset ability of the toner. Unreacted part of the glycidyl group-containing vinyl resin remains excessively, so that the toner will adhere to a developer carrier and the like and the developing ability of the toner is affected.

A vinyl monomer to be copolymerized with a glycidyl group-containing monomer will be described below. Examples of the vinyl monomer include: styrene and styrene derivatives such as styrene, o-methylstyrene, m-methylstyrene, p-methylstyrene, p-methoxystyrene, p-phenylstyrene, p-chlorstyrene, 3,4-dicholrostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylene unsaturated monoolefins such as ethylene, propylene, butylene, and isobutylene; unsaturated polyenes such as butadiene; vinyl halides such as vinyl chloride, vinylidene chloride, vinyl bromide, and vinyl fluoride; vinyl esters such as vinyl acetate, vinyl propionate, and vinyl benzoate; a-methyl aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide; and the above-mentioned α,β-unsaturated ester and dibasic diesters. At least one of them is used. Of those, a combination of monomers to provide a styrene copolymer or a styrene-acryl copolymer is preferable.

In the present invention, for the production of a styrene/acryl resin, a carboxyl group-containing vinyl resin and a glycidyl group-containing vinyl resin may be prepared in advance. In addition, the reaction between the carboxyl group-containing vinyl resin and the glycidyl group-containing vinyl resin may be carried out such that, for example, (1) the respective resins being melt are mixed and heated in a reaction chamber to cause a cross-linking reaction, or (2) the respective resins are melt-kneaded under heat by means of a double-screw extruder to cause a cross-linking reaction. It is noted that, for the generation of an entangled component having an extended distance between cross-linking points, it is preferable to cause a cross-linking reaction by melt kneading under heat using a double-screw extruder. After completion of the cross-linking reaction, the product may be cooled slowly to allow the generation of an entangled component. Specifically, after completion of the reaction, the temperature of the product is lowered at a rate of 1° C./min or less. On the way, the product may be kept at a predetermined temperature for several hours, followed by decreasing the temperature of the product to room temperature. In this way, an entangled component can be slowly generated by cooling down slowly.

As described above, a styrene/acryl resin is obtained by reacting the carboxyl group-containing vinyl resin with the glycidyl group-containing vinyl resin.

Furthermore, in the present invention, the content of the THF-insoluble fraction C, which is an extraction residue obtained by carrying out Soxhlet extraction of the styrene/acryl resin with tetrahydrofuran (THF) for 16 hours, may be 0% by mass to 10% by mass. If the content of the THF-insoluble fraction C exceeds 10%, the cross-linking reaction proceeds excessively, causing an increase in amount of a component having a net structure. In the pulverization step at the time of toner production, the amount of a component having strong brittleness increases. Therefore, the grindability of the toner will be affected. In addition, the molecular breakage at the time of kneading is accelerated to reduce the anti-high-temperature offset ability of the toner. As the melt viscosity of the resin itself increases, the dispersibility of a raw material decreases in the kneading step and the durable developing ability decreases.

The binder resin of the present invention may include another resin in addition to the styrene/aryl resin described above. A preferable additional resin is, for example, a copolymer having as a monomer unit an aliphatic conjugate diene compound, a diene resin. Including such a copolymer having a comparatively long chain and elasticity accelerates the generation of entangled molecules at the time of toner formation. Furthermore, when such a resin is trapped in a net structure, the space volume of the structure can be extended to form a false cross-linking component having good elasticity in spite of the low molecular weight of the resin.

The content of the diene resin in the binder resin is preferably 0 to 40% by mass (more preferably 5 to 35 by mass). If the content of such a resin exceeds 40% by mass, the softening point of the binder resin undesirably increases. A preferable fixing ability of the toner cannot be obtained.

Examples of a monomer of an aliphatic conjugate diene constituting the above copolymer include 1,3-butadiene, 2-methyl-1,3-butadiene, 2-ethyl-1,3-butadiene, 2-phenyl-1,3-butadiene, 2,3-dimethyl-1,3-butadiene, 1,4-diphenyl-1,3-butadiene, 1,1,4,4,-tetraphenyl-1,3-butadiene, 1,3-pentadiene, 2-methyl-1,3-pentadiene, 2-ethyl-1,3-pentadiene, 3-methyl-1,3-pentadiene, 4-methyl-1,3-pentadiene, 1,3-hexadiene, 2,4-hexadiene, 2,3-dimethyl-1,3-hexadiene, 2,5-dimethyl-2,4-hexadiene, 1,3-heptadiene, 2,4-heptadiene, 2,3-dimethyl-1,3-heptadiene, 1,3-octadiene, 2,4-octadiene, 2,3-dimethyl-1,3-octadiene, 3,4-dimethyl-1,3-octadiene, 1,3-nonadiene, 2,4-nonadiene, and 2,3-dimethyl-1,3-nonadiene, and derivatives thereof. A copolymer containing an aliphatic conjugate diene compound as a monomer unit can be obtained by combinating with at least one of the above vinyl monomers. Of those, a copolymer obtained by combinating a styrene compound as a vinyl monomer and 1,3-butadiene, 2-methyl butadiene, or 1,3-pentadiene as a conjugate diene compound is preferable.

In addition, a styrene compound/aliphatic conjugate diene compound is desirably copolymerized at a ratio of 65/35 to 98/2. This is because the grass transition temperature of the copolymer decreases when the content of the styrene compound is less than 65% by mass, resulting in deteriorated storage stability. On the other hand, if the content of the styrene compound exceeds 98% by mass, the grass transition temperature increases and the fixing ability of the toner deteriorates.

Hereinafter, measuring methods for the physical properties of the toner according to the present invention will be described bellow.

[Measurement of THF-Insoluble Fraction]

A toner sample of about 1.0 g is weighed (W1 g) and placed in cylindrical filter paper (e.g., No. 86 R size 28×100 mm, manufactured by Toyo Roshi Co., Ltd.) and then subjected to a Soxhlet extractor for extraction for 16 hours using 200 ml of THF as a solvent. At this time, the extraction is conducted at a reflux speed such that the extraction cycle of the solvent is once per about 4 to 5 minutes. After completion of the extraction, the cylindrical filter paper is removed and dried at 40° C. for 8 hours under vacuum, followed by weighing an extraction residue (W2 g). Subsequently, the incinerated remaining ash fraction in the toner is weighed (W3 g). The mass of incinerated remaining ash fraction is obtained by the following procedures. About 2 g of the sample is placed in a 30-ml magnetic crucible previously weighed in a precise manner and then the mass (Wa g) of the sample is precisely weighed. The crucible is placed in an electric furnace and heated at 900° C. for about 3 hours. After that, the sample is cooled down in the electric furnace and then left alone in a desiccator to cool it down at room temperature for 1 hour or more. Subsequently, the mass of the crucible is precisely weighed. The mass of an incinerated remaining ash fraction (Wb g) is determined from this.

$$(Wb/Wa)\times 100=\text{Incinerated remaining ash fraction content (\% by mass)} \quad (1)$$

From the content of the formula (1), the mass (W3 g) of the incinerated remaining ash fraction in the sample W1 g can be represented by (Wb/Wa)×W1.

The THF-insoluble fraction A can be determined from the following formula (2).

$$\text{THF-insoluble fraction } A\text{(\% by mass)}=[W2-W3]/[W1-W3]\times 100 \quad (2)$$

In the present invention, the content of each component is obtained on the basis of the mass of the binder resin in the toner by subtracting the mass of the incinerated remaining ash fraction from the mass of toner.

Furthermore, the THF-insoluble fraction C when the styrene/acryl resin in a binder resin is used as a sample can be determined from the following formula (3) by calculating the extraction residue (W2 g) by the same process as that described above after weighing the predetermined amount (W1 g) of the styrene/acryl resin.

$$\text{THF-insoluble fraction } C\text{ (\% by mass)}=W2/W1\times 100 \quad (3)$$

[Measurement of TOL-Insoluble Fraction]

The measurement of the amount of an insoluble fraction obtained by re-extraction of the THF-insoluble fraction A with TOL is performed by subjecting the cylindrical filter paper used for determining the extraction residue (W2 g) to Soxhlet extraction again with 200 ml TOL for 16 hours. At this time, the extraction is conducted at a reflux speed such that the extraction cycle of the solvent is once per about 4 to 5 minutes. After completion of the extraction, the cylindrical filter paper is removed and dried under vacuum at 40° C. for 8 hours, followed by weighing the TOL extraction residue (W4 g).

The TOL-insoluble fraction B can be determined from the following formula (4):

$$\text{TOL-insoluble fraction } B\text{ (\% by mass)}=[W4-W3]/[W1-W3]\times 100 \quad (4)$$

[Measurement of Molecular Weight Distribution with GPC]

A column is stabilized in a heat chamber at 40° C.

Then, THF provided as a solvent is flowed into the column at that temperature at a flow rate of 1 ml/min. A THF sample solution of about 100 μl in content is introduced into the column for the measurement. For determining the molecular weight of the sample, the molecular weight distribution of the sample is calculated on the basis of the relation between a counted amount and the logarithm value of an analytical curve prepared from several kinds of mono dispersion polystyrene standard samples. The standard polystyrene samples for preparing the analytical curve are, for example, those available from Tosoh Corp. or Showa Denko K.K., and having molecular weights of about $10^2$ to $10^7$. Preferably, about 10 standard polystyrene samples are used. In addition, a detector used is an RI (index of refraction) detector. The column may be a combination of two or more polystyrene gel column, for example a combination of Shodex GPC KF-801, 802, 803, 804, 805, 806, 807, and 800P, manufactured by Showa Denko K.K., or a combination of TSKge1G1000H ($Hx_L$), G2000H($H17x_L$), G3000H($Hx_L$), G4000H($Hx_L$), G5000H($Hx_L$), G6000H($Hx_L$), G7000H($Hx_L$), and TSKgurd column, manufactured by Tosoh Corp.

The samples are prepared as follows. At first, a sample is placed in THF and then left standing for several hours, followed by sufficiently shaking to mix the sample with THF well (until the coalesced parts of the sample disappears). Then, the sample is let alone for additional 12 hours or more. At this time, the time period for leaving the sample alone in THF is 24 hours or more. Subsequently, the sample is filtrated through a sample-processing filter (0.2 to 0.5 μm in pore size, such as Myshori Disk H-25-2 (manufactured by Tosoh Corp.)) and then provided as a sample for GPC. In addition, the concentration of the sample is adjusted such that the content of a resin component is within the range of 0.5 to 5 mg/ml. Furthermore, a THF-soluble component obtained by Soxhlet extraction of the present invention is passed through a sample-processing filter (0.2 to 0.5 μm in pore size, such as Myshori Disk H-25-2 (manufactured by Tosoh Corp.)) and then provided as a sample for GPC. For a TOL-soluble fraction, a soluble component solution is subjected to evaporation and then subjected to sample preparation.

[Measurement of Epoxy Number]

Basic procedures are based on JIS K-7236.

1) 0.5 to 2.0 g of a sample is weighed and the weight of a resin is defined as W (g).

2) The sample is placed in a 300-ml beaker and dissolved in 10 ml of chloroform and 20 ml of acetic acid.

3) In this solution, 10 ml of a tetraethylammonium bromide in acetic acid is added.

4) Using a 0.1 mol/l acetic hyperchloride solution, titration is performed by a potentiometric titration device (e.g., automatic titration using a potentiometric titration device AT-400 (Win Workstation) manufactured by Kyoto Electrics Co., Ltd. and ABP-410 Electric burette can be applied).

5) The amount of the acetic hyperchloride solution used at this time is defined as S ml. Simultaneously a blank is measured and at this time the amount of the acetic hyperchloride solution used is defined as B ml.

6) The epoxy number is calculated using the following formula (5). In the formula, "f" is a factor of the acetic hyperchloride solution.

$$\text{Epoxy number (eq/kg)}=0.1\times f\times(S-B)/W \quad (5)$$

[Measurement of Acid Value]

Basic procedures are based on JIS K-0070.

1) The ground product of the resin, 0.5 to 2.0 (g), is weighed precisely and the weight of the binder resin is defined as W (g).

2) The sample is placed in a 300-ml beaker and a 150-ml mixture of toluene/ethanol (4/1) is added to dissolve the sample.

3) Using a 0.1 N solution of KOH in methanol, titration is performed by means of a potentiometric titration device (e.g., automatic titration using a potentiometric titration device AT-400 (Win Workstation) manufactured by Kyoto Electrics Co., Ltd. and ABP-410 Electric burette can be applied).

4) The amount of the KOH solution used at this time is defined as S ml. Simultaneously a blank is measured and at this time the amount of the KOH solution used is defined as B ml.

5) The acid value is calculated using the following formula (6). In the formula, "f" is a factor of KOH.

$$\text{Acid value (mgKOH/g)}=((S-B)\times f\times 5.61)/W \quad (6)$$

It is possible that the binder resin used in the present invention be added with any one of the following polymers.

Specific examples thereof include: single polymers of styrene and derivatives thereof such as polystyrene, poly-p-chlorstyrene, and polyvinyltoluene; styrene copolymers such as a styrene-p-chlorstyrene copolymer, a styrene-vinyltoluene copolymer, a styrene-vinylnaphthalene copolymer, a styrene-acrylate copolymer, a styrene-methacrylate copolymer, a styrene-a-chlormethacrylate copolymer, a styrene-acrylonitrile copolymer, a styrene-vinylmethylether copolymer, a styrene-vinylethylether copolymer, a styrene-vinylmethylketone copolymer, and a styrene-acrylonitrile-indene copolymer; polyvinyl chloride; a phenol resin; a natural degenerative phenol resin; a natural resin degenerative maleic acid resin; an acryl resin; a methacryl resin; polyvinyl acetate; a silicone resin; a polyester resin; polyurethane; a polyamide resin; a furan resin; an epoxy resin; a xyrene resin; polyvinyl butyral; a terpene resin; a coumarone-indene resin; and a petroleum resin.

The toner used in the present invention may contain charge control agents in order to retain a positive charge or a negative charge. Examples of charge control agents that control the toner particles to positive charges include: materials modified by nigrosine and fatty acid metallic salts; quaternary ammonium salts such as tributylbenzylammonium-1-hydroxy-4-naphthosulfonate and tetrabutylammoniumtetrafluoroborate, and onium salts such as phosphonium salt which are analogs thereof, and lake pigments thereof; triphenylmethane dyes and lake pigments thereof (examples of lake activating agents include phosphotungstic acid, phosphomolybdic acid, phosphotungsten molybdic acid, tannic acid, lauric acid, gallic acid, ferricyanides, and ferrocyanides); metallic salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate; guanidine compounds; and imidazole compounds. Those may be used separately or two or more types thereof may also be used in combination. Of those, a triphenylmethane compound, an imidazole compound, and a quaternary ammonium salt whose counterion is not halogen are preferably used. Further, charge control agents that control the toner particles to negative charges will be described below. Organometallic complexes and chelate compounds are effective. Examples thereof include monozaometallic complexes, acetylacetone metallic complexes, and metallic complexes of aromatic hydroxy carboxylates and of aromatic dicarboxylates. The examples further include: aromatic hydroxy carboxylic acids; aromatic monocarboxylic and polycarboxylic acids, and metallic salts, anhydrides, and esters thereof; and phenol derivatives such as bisphenol.

As a method of adding a charge control agent to a toner, there are a method involving adding the agent into the inside of the toner and a method involving externally adding to the toner. The amount of the charge control agent used is determined on the basis of the type of a binder resin, the presence or absence of other additives, and a toner production method including a dispersion method. The charge control agent is used, but not specifically limited to, preferably 0.1 to 10 parts by mass, more preferably 0.5 to 5 parts by mass with respect to 100 parts by mass of the binder resin.

In the present invention, the following waxes may be added to the toner for providing the toner with mold release characteristics. Waxes having melting points of 70 to 165° C. and melt viscosities of 1000 mPa·S or less at 160° C. Specific examples of the waxes include: paraffin wax; microcrystalline wax; Fischer-Tropsch wax; montan wax; and linear α-olefin such as ethylene, propylene, butene, pentene, hexene, heptene, octene, nonene, or decene; branched α-olefin having a branched portion on its end terminal; and single polymers of olefines having unsaturated groups on different positions, or copolymers thereof. In addition, alcoholic wax, fatty acid wax, ester wax, natural wax are used, too. Furthermore, a block copolymer prepared using a vinyl monomer may be used. Alternatively, modified wax prepared by subjecting to graft modification, or oxidized wax subjected to oxidation may be used.

Those waxes may be previously added to or mixed with polymer components in the production of toner. In this case, a preferable method at the time of preparing polymer components involves: dissolving the wax and a high-molecular-weight polymer in a solvent; and mixing the resultant with a low-molecular-weight polymer solution. This relaxes a phase separation in a micro area and controls the regulation of the high-molecular weight component, while also attaining its good dispersion state with the low-molecular-weight polymer.

In addition, the addition amount of the above wax is preferably 0.1 to 20 parts by mass, more preferably 1 to 10 parts by mass with respect to 100 parts by mass of the binder resin. Also, two or more waxes may be added in combination.

The toner added with those waxes preferably has a maximum endothermic peak in the region of 60 to 120° C. in an endothermic curve, which is obtained by differential thermal analysis (DSC) on the toner.

If the maximum peak is found in the above range of temperatures, the toner represents good fixing and anti-offset abilities. However, if the maximum peak is found at a temperature of less than 60° C., the storage ability of the toner decreases because of a plasticization effect of the wax. If the maximum peak is found at a temperature of more than 120° C., the fixing ability of the toner decreases. Here, the maximum endothermic peak can be determined as follows.

In the present invention, for a DSC measurement of wax or toner with a differential scanning calorimeter, DCS-7 manufactured by Perkin-Elmer Co., Ltd. and DSC290 manufactured by TA instruments Japan, Co, Ltd. can be used. The measurement is carried out on the basis of ASTM D3418-82. The DSC curve used in the present invention is one obtained by: rising the temperature once to take a previous history; performing measurement while lowering the temperature at 10° C./min in the range of 0 to 200° C.; and rising the temperature to measure a DSC curve.

The colorants, which can be used in the toner of the present invention, include any appropriate pigments or dyes. Examples of the pigments include carbon black, aniline black, acetylene black, naphthanol yellow, Hansa yellow, rhodamine lake, arizaline lake, red oxide, phthalocyanine blue, and indanthrene blue. Each of them may be used in an amount required for keeping an optical density of a fixed image. That is, the amount is 0.1 to 20 parts by mass, preferably 0.2 to 10 parts by mass with respect to 100 parts by mass of the binder resin. For the same purpose, dyes may be further used. Examples of the dyes include azo, anthraquinone, xanthene, and methine dyes. Each of them is added in an amount of 0.1 to 20 parts by mass, preferably 0.3 to 10 parts by mass with respect to 100 parts by mass of the binder resin.

In the toner of the present invention, magnetic iron oxide may be used as a colorant. It may be also used as a magnetic toner.

A number average particle size of magnetic iron oxide is preferably 0.05 to 1.0 μm, more preferably 0.1 to 0.6 μm. In addition, magnetic iron oxide used in the present invention is favorably in the form of an octahedral or plural nuclei form in terms of the dispersibility of magnetic iron oxide in the toner. The amount of magnetic iron oxide particles in the present invention is 20 to 200 parts by mass, preferably 20 to 170 parts by mass, more preferably 30 to 150 parts by mass with respect to 100 parts by mass of a binder resin.

In the toner of the present invention, for improving charging stability, developing ability, fluidity, and durability, it is preferable to add silica fine powder to the toner.

For obtaining good results, the silica fine powder used in the present invention has a specific surface area of 30 $m^2/g$ or more, particularly of 50 to 400 $m^2/g$ on the basis of a BET method with nitrogen adsorption. It is favorable to use the silica fine powder in an amount of 0.01 to 8 parts by mass, preferably 0.1 to 5 parts by mass with respect to 100 parts by mass of the toner. The silica fine particles used in the present invention may be treated, if required for the purpose of imparting hydrophobic property or for control of charging property, with treating agents such as silicon varnish, various denatured silicone varnish, a silicone oil, various denatured silicone oils, a silane coupling agent, silane compounds having functional groups, and organic silicon compounds, or with a combination of various treating agents.

The toner of the present invention may be added with other external additives, if required. Examples of the additives include a charging auxiliary agent, a conductivity providing agent, a fluidity providing agent, a caking preventive agent, a mold release agent at the time of fixation with a heat roller, and resin fine particles and inorganic fine particles that act as a lubricant, abrasive, and the like. The lubricants include polyethylene fluoride powder, zinc stearate powder, and polyvinylidene fluoride powder. Of those, polyvinylidene fluoride is preferable. In addition, the abrasives include cerium-oxide powder, silicon carbide powder, and strontium titanate powder. Of those, strontium titanate powder is preferred. The fluidity providing agents include titanium oxide powder and aluminum oxide powder. Of those, hydrophobic one is preferred. Conductivity providing agents include carbon black powder, zinc oxide powder, antimony oxide powder, and tin oxide powder. Furthermore, white fine particles and black fine particles opposite in polarity can be used in a small amount as an agent for improving the developing ability of the toner.

For preparing the toner of the present invention, a binder resin, a colorant, and other additives are sufficiently mixed by means of a mixer such as a Henschel mixer or a ball mill and then melt-kneaded using a thermal kneader such as a heating roller, kneader, or extruder, and cooled and solidified, followed by grinding and classification. Furthermore, if required, a desired additive may be sufficiently mixed with the above components by means of a mixer such as a Henschel mixer, thereby obtaining the toner of the invention.

In the present invention, in order to generate effectively an entangled component, it is important to control the retention time of a toner in the step of kneading the toner and control the temperature of a resin at the time of kneading. The temperature of the resin at the time of kneading is preferably in the range of 130 to 170° C. If the temperature of the resin is less than 130° C., the share at the time of kneading increases and the breakage proceeds more than the entanglement. In addition, if the temperature of the resin exceeds 170° C., a cross-linking reaction proceeds excessively. Thus, a component having a net structure tends to be generated.

In the present invention, furthermore, in order to generate effectively an entangled component, it is preferable to open a vent port in the upper part of a kneading zone of a kneader during the step of kneading a raw materials of a toner. Opening the vent port in the upper part of the kneading zone and then kneading allows a kneading share under an atmospheric condition but not under pressure at the time of toner formation. That is, as the kneading is performed while the air is taken, a component having an entangled structure with a wide distance between cross-linking points tends to be generated.

Examples of the mixer include: Henschel mixer (manufactured by Mitsui Mining Co., Ltd.); Super mixer (manufactured by Kawata Mfg. Co., Ltd.); Ribocone (manufactured by Okawara Mfg. Co., Ltd.); Nauta mixer, Turbulizer, and Cyclomix (manufactured by Hosokawa Micron Corporation); Spiral pin mixer (manufactured by Pacific Machinery & Engineering Co., Ltd.); and Redige mixer (manufactured by Matsubo Corporation). Further, examples of the kneader include: KRC kneader (manufactured by Kurimoto, Ltd.); Buss-Co-Kneader (manufactured by Coperion BUSS AG); TEM extruder (manufactured by Toshiba Machine Co., Ltd.); TEX twin screw kneader (manufactured by Japan Steel Works, Ltd.); PCM kneader (manufactured by Ikegai, Ltd.); Three roll mill, Mixing roll mill, and Kneader (manufactured by Inoue-Nissei Engineering Pte., Ltd.); Kneadex (manufactured by Mitsui. Mining Co., Ltd.); MS type pressurizing kneader and Kneader ruder (manufactured by Moriyama Co., Ltd.); and Banbury mixer (manufactured by Kobe Steel, Ltd.). Further, examples of a pulverizer include: Counter jet mill, Micron jet, and Inomizer (manufactured by Hosokawa Micron Corporation); IDS type mill and PJM jet pulverizer (manufactured by Nippon Pneumatic Mfg. Co., Ltd.); Cross-jet Mill (manufactured by Kurimoto, Ltd.); Ulmax (manufactured by Nisso Engineering Co., Ltd.); SK Jet-O-Mill (manufactured by Seisin Enterprise Co., Ltd.); Cliptron (manufactured by Kawasaki Heavy Industries, Ltd.); Turbo Mill (manufactured by Turbo Kogyo Co., Ltd.); and Super Rotor (manufactured by Nisshin Engineering Inc.). Further, examples of the classifier include: Classiel, Micron Classifier, and Spedic Classifier (manufactured by Seisin Enterprises Co., Ltd.); Turbo Classifier (manufactured by Nisshin Engineering Co., Ltd.); Micron separator, Turboplex (ATP), and TSP Separator (manufactured by Hosokawa Micron Co., Ltd.); Elbow-Jet (manufactured by Nittetsu Mining Co., Ltd.); Dispersion Separator (manufactured by Japan Pneumatic Co., Ltd.); and YM Microcut (manufactured by Yasukawa Electric Co., Ltd.). Further, examples of a screening device for sifting coarse particles or the like include: Ultra Sonic (manufactured by Koei Sangyo Co., Ltd.); Resona Sieve and Gyro Sifter (manufactured by Tokuju Corporation); Vibrasonic System (manufactured by Dalton Corporation); Soniclean (manufactured by Sinto Kogyo Co., Ltd.); Turbo Screener (manufactured by Turbo Kogyo Co., Ltd.); Micro Sifter (manufactured by Makino Mfg. Co., Ltd.); and Circular Oscillation Screens.

EXAMPLES

Hereinafter, the present invention will be described with reference to examples. Here, the term "part" used in the examples represents "part by mass".

At first a styrene/acryl resin according to the present invention was produced through the following steps.

<Production Example of High-Molecular-Weight Resin Component (A-1)>

In a four-necked flask, 300 parts by mass of xylene was introduced. Then, the inside of the flask was sufficiently replaced with nitrogen while stirring, followed by rising the temperature for reflux.

Under the reflux, at first, a mixture solution of 80 parts by mass of styrene, 16 parts by mass of n-butyl acrylate, and 0.8 part by mass of 2,2-bis(4,4-di-tert-butyl peroxycyclohexyl) propane (also referred to as "Initiator 1", half life: 10 hours and temperature: 92° C.) was dropped over 4 hours. When the mixture solution was dropped for 2 hours, a mixture of 4 parts by mass of methacrylic acid and 20.2 parts by mass of Initiator 1 was dropped over 2 hours. After the solutions had been dropped completely, the mixture was retained for 2 hours to complete a polymerization, thereby obtaining a high-molecular-weight resin component (A-1) solution. In this way, a resin having no acid value is polymerized as a block in advance, and an acid monomer is then dropped onto the block to polymerize with each other, thereby allowing the generation of a high-molecular-weight resin component having a longer distance between cross-linking points.

<Production of High-Molecular-Weight Resin Component (A-2)>

Like the production example of the high-molecular-weight resin component (A-1), 75 parts by mass of styrene, 18 parts by mass of n-butyl acrylate, 7 parts by mass of methacrylic acid, and 1 part by mass of Initiator 1 were used to obtain a high-molecular-weight resin component (A-2) solution.

<Production of High-Molecular-Weight Resin Component (A-3)>

Like the production example of the high-molecular-weight resin component (A-1), 72 parts by mass of styrene, 23 parts by mass of n-butyl acrylate, 5 parts by mass of methacrylic acid, and 1 part by mass of Initiator 1 were used to obtain a high-molecular-weight resin component (A-3) solution.

<Production of High-Molecular-Weight Resin Component (A-4)>

Like the production example of the high-molecular-weight resin component (A-1), 70 parts by mass of styrene, 27 parts by mass of n-butyl acrylate, 3 parts by mass of methacrylic acid, and 1 part by mass of Initiator 1 were used to obtain a high-molecular-weight resin component (A-4) solution.

<Production of High-Molecular-Weight Resin Component (A-5)>

In a four-necked flask, 180 parts by mass of degassed water and 20 parts by mass of a 2% by mass aqueous solution of polyvinyl alcohol were introduced. Then, the flask was added with a mixture solution of 70 parts by mass of styrene, 25 parts by mass of n-butyl acrylate, 5 parts by mass of monobutyl maleate, 0.005 part by mass of divinyl benzene, and 0.1 part by mass of Initiator 1, and the whole was stirred to obtain a suspension. The inside of the flask was sufficiently replaced with nitrogen and then warmed up to 85° C. to initiate polymerization. The reaction mixture was left standing at this temperature for 24 hours and then added with 0.1 part by mass of benzoyl peroxide (half life: 10 hours and temperature: 72° C.). Subsequently, the reaction mixture was further left standing for 12 hours to complete polymerization. After that, a high-molecular-weight polymer was isolated by filtration, washed with water, and then dried. Consequently, a high-molecular-weight resin component (A-5) was obtained.

<Production of Low-Molecular-Weight Resin Component (B-1)>

In a four-necked flask, 300 parts by mass of xylene was introduced and then stirred while the inside of the flask was replaced with nitrogen, followed by warming up for reflux. Under the reflux, a mixture solution of 75 parts by mass of styrene, 25 parts by mass of n-butyl acrylate, and 2 parts by mass of di-tert-butylperoxide (referred to as "Initiator 2") was dropped into the flask over 4 hours, followed by keeping the reaction mixture as it is for 2 hours to complete polymerization. Consequently, a low-molecular-weight resin solution (B-1) was obtained.

<Production of Low-Molecular-Weight Resin Component (B-2)>

Polymerization was performed by the same process as in the production example of the low-molecular-weight resin component B-1, using 78 parts by mass of styrene, 22 parts by mass of n-butyl acrylate, and 2.5 parts by mass of Initiator 2, to obtain a low-molecular-weight resin component solution B-2.

<Production of Low-Molecular-Weight Resin Component (B-3)>

Polymerization was performed by the same process as in the production example of the low-molecular-weight resin component B-1, using 80 parts by mass of styrene, 20 parts by mass of n-butyl acrylate, and 2 parts by mass of Initiator 2, to obtain a low-molecular-weight resin component solution B-3.

<Production of Vinyl Resin Containing Glycidyl Group (D-1)>

In a four-necked flask, 300 parts by mass of xylene was added. Then, the inside of the flask was sufficiently replaced with nitrogen while stirring, followed by warming up for reflux.

Under the reflux, a mixture solution containing 80 parts by mass of styrene, 18 parts by mass of n-butyl acrylate, and 1.8 parts by mass of di-tert-butylperoxide (Initiator 2) was dropped into the flask over 4 hours. When the mixture solution was dropped for 2 hours, a mixture solution of 2 parts by mass of glycidyl methacrylate and 0.2 part by mass of Initiator 2 was dropped over 2 hours. After completion of the dropping, the reaction mixture was left standing for 2 hours to complete polymerization and the solvent was then distilled off under reduced pressure, thereby obtaining a glycidyl group-containing vinyl resin (D-1). The weight average molecular weight and epoxy number of the resulting vinyl resin are shown in Table 1. Accordingly, it becomes possible to produce a glycidyl group-containing vinyl resin with a longer distance between cross-linking points by polymerizing a polymer free of acid value as a block in advance and dropping a monomer containing a glycidyl group onto the block so as to be polymerized with the polymer.

<Production of Vinyl Resin Containing Glycidyl Group (D-2)>

Like the production example of the glycidyl group-containing vinyl resin (D-1), 75 parts by mass of styrene, 15 parts by mass of n-butyl acrylate, 10 parts by mass of glycidyl methacrylate, and 3 parts by mass of Initiator 2 were used to obtain a glycidyl group-containing vinyl resin (D-2). The weight average molecular weight and epoxy number of the resulting vinyl resin are shown in Table 1.

TABLE 1

| Glycidyl group-containing vinyl resin | | |
|---|---|---|
| | D-1 | D-2 |
| Mw | 15000 | 20000 |
| Epoxy number(eq/kg) | 0.1 | 1.0 |

<Production of Styrene/Acryl Resin (C-1)>

In a four-necked flask, 200 parts by mass of a xylene solution containing the above low-molecular-weight resin component (B-2) (corresponding to 60 parts by mass of a low-molecular-weight resin component) was introduced. Then, the solution was warmed up and stirred under reflux. In the meantime, in another vessel, 200 parts by mass of the high-molecular-weight resin component (A-3) (corresponding to 40 parts by mass of a high-molecular-weight component) was introduced, followed by reflux. The above low-molecular-weight resin component (B-2) solution was mixed with the above high-molecular-weight resin component (A-3) solution under reflux, followed by distilling the organic solvent off. The resulting resin was cooled and solidified, followed by pulverizing. 95 parts by mass of a carboxyl group-containing vinyl resin obtained by mixing the low-molecular-weight resin component with the high-molecular-weight resin component was mixed with 5 parts by mass of the glycidyl group-containing vinyl resin (D-1) using a Henschel mixer. Then, in a biaxial extruder, the mixture was subjected to a cross-linking reaction at 200° C. and then cooled down at a cooling rate of 1° C./min. Subsequently, the product was pulverized to obtain a styrene/acryl resin (C-1). The resulting resin was subjected to 16-hour extraction with THF. Consequently, the resulting THF-insoluble fraction C was 0.1% by mass in volume. In addition, a higher molecular weight region peaked at a molecular weight of 230,000 and a lower molecular weight region peaked at a molecular weight of 12,300. The results of the resin, including the THF-insoluble fraction C and peak molecular weights, are listed in Table 2 below.

<Production of Styrene-Acryl Resins (C-2 to C-7)>

In a manner similar to the production example of the styrene/acryl resin (C-1), styrene/acryl resins (C-2 to C-7) were prepared by making combinations of the high-molecular-weight resin component solutions (A-1 to A-5) and the low-molecular-weight resin component solutions (B-1 to B-3) as listed in Table 2 below and then further combining with one of the glycidyl group-containing vinyl resins (D-1 and D-2) under the certain cross-linking reaction temperatures and cooling temperatures listed in Table 2. The results of each resulting resin, including a THF-insoluble fraction C and peak molecular weights, are listed in Table 2. Furthermore, in Table 2, C/G represents the mixing ratio of the vinyl resin containing a carboxyl group to the vinyl resin containing a glycidyl group.

Example 1

The materials listed below were premixed using a Henschel mixer and then melt-kneaded using a biaxial kneading extruder (kneader). At this time, a vent port in a kneading member of the kneader was opened and a time period for retaining the kneaded resin was then controlled so that the temperature of the kneaded resin was adjusted to 150° C.

Styrene/acryl resin C-1: 80 parts by mass

Diene resin (styrene-butadiene copolymer):

20 parts by mass (Styrene:butadiene=85:15 (mass ratio), peak molecular weight=25,000, Mw ~270,000, Mn=20,000)

Magnetic iron oxide particles (octahedron, number average particle size ~0.21 μm):

90 parts by mass

Wax a: 4 parts by mass

Wax b: 2 parts by mass

Charge control agent A (triphenylmethane lake pigment):

2 parts by mass (but, in the above materials, the alphabetical marks on the respective waxes correspond to those found in Table 3 below (the same will be applied on other examples described latter), and the charge control agent A is represented by the structural formula (A) below).

TABLE 2

| | Styrene/acryl resin | | | | | | |
|---|---|---|---|---|---|---|---|
| | C-1 | C-2 | C-3 | C-4 | C-5 | C-6 | C-7 |
| High-molecular-weight resin component | A-3 | A-2 | A-1 | A-4 | A-1 | A-3 | A-5 |
| Low-molecular-weight resin component | B-2 | B-2 | B-3 | B-1 | B-2 | B-1 | B-3 |
| High/Low | 40/60 | 30/70 | 30/70 | 50/50 | 20/80 | 50/50 | 30/70 |
| MpH | 230000 | 330000 | 400000 | 120000 | 403000 | 220000 | 805000 |
| MpL | 12300 | 12500 | 15100 | 8300 | 12300 | 8500 | 15300 |
| Glycidyl group-containing vinyl resin | D-1 | D-1 | D-2 | D-1 | D-1 | D-2 | — |
| Mixing ratio of resin (C/G) | 95/5 | 97/3 | 95/5 | 93/7 | 97/3 | 98/2 | — |
| Cross-linking reaction temperature | 200° C. | 190° C. | 200° C. | 200° C. | 190° C. | 180° C. | — |
| Cooling temperature | 1.0° C./min | 0.8° C./min | 1.0° C./min | 0.8° C./min | 0.5° C./min | 3.0° C./min | 3.0° C./min |
| THF-insoluble fraction (% by mass) | 0.1% | 0.2% | 10% | 0.3% | 2.3% | 1.8% | 28.0% |

TABLE 3

| Wax | | |
|---|---|---|
| | Composition | DSC maximum endothermic peak temperature (° C.) |
| Wax a | Paraffin wax | 75 |
| Wax b | Fischer-Tropsch wax | 101 |
| Wax c | Higher-alcohol wax (hydroxyl value 70 mg KOH/g) | 100 |

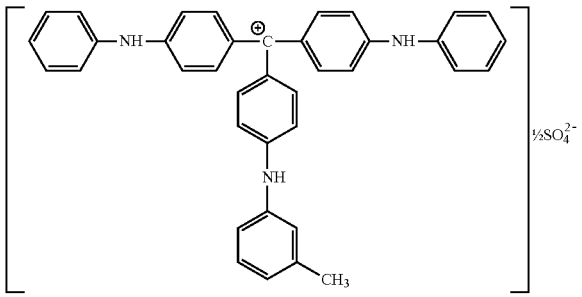

(A)

The resulting kneaded product was cooled and roughly pulverized with a hammer mill and then finely pulverized with a jet-stream pulverizing mill. The resulting pulverized powder was classified using a fractionating classifier based on Coanda effect to obtain toner particles with a weight average particle size of 7.5 μm. Subsequently, 0.8 part by mass of hydrophobic silica fine powder (prepared by treating 100 parts of parental silica with 17 parts of amino-denatured silicone oil (amino equivalent=830, viscosity at 25° C.=70 $mm^2/s$), BET specific surface area=140 $m^2/g$) and 3.0 parts by mass of strontium titanate were externally added to 100 parts by mass of the toner particles and then the whole was filtrated through a 150-μm pore size mesh filter, thereby obtaining Toner No. 1.

The internal formulation and physical properties of the toner are listed in Table 4.

TABLE 4

| Physical properties of the toner | | | | | | | | |
|---|---|---|---|---|---|---|---|---|
| Toner No. | Example 1 1 | Example 2 2 | Example 3 3 | Example 4 4 | Example 5 5 | Example 6 6 | Example 7 7 | Example 8 8 |
| Styrene/acryl resin (1) | C-1 | C-2 | C-3 | C-3 | C-4 | C-5 | C-1 | C-3 |
| Diene resin (2) | Present | Present | Present | Absent | Absent | Absent | Present | Absent |
| Mixing ratio of resin ((1)/(2)) | 80/20 | 70/30 | 80/20 | — | — | — | 80/20 | — |
| Charge control agent | 1 | 1 | 1 | 1 | 1 | 1 | 2 | 2 |
| Wax | a/b | a/c | c | c | a/b | a/b | a/b | c |
| Magnetic iron oxide particles | Octahedron | Octahedron | Octahedron | Octahedron | Plural nuclei | Plural nuclei | Plural nuclei | Plural nuclei |
| Vent port in upper part of kneading member | Opened | Opened | Opened | Opened | Opened | Opened | Opened | Opened |
| Temperature of resin | 150° C. | 160° C. | 160° C. | 160° C. | 155° C. | 155° C. | 150° C. | 160° C. |
| DSC maximum endothermic peak temperature (° C.) | 72.5° C. | 72° C. | 102° C. | 101° C. | 74° C. | 72° C. | 72.5° C. | 99° C. |
| THF-insoluble fraction A (% by mass) | 41% | 32% | 42.1% | 29.4% | 51% | 25% | 40.8% | 30.1% |
| THF-soluble fraction MP | 12000 | 11800 | 15700 | 16000 | 8800 | 12800 | 12200 | 16200 |
| THF-soluble fraction 100,000% or less | 79% | 85% | 95% | 92% | 98% | 82% | 78% | 91% |
| TOL-insoluble fraction B (% by mass) | 8.2% | 6.1% | 12.1% | 10.6% | 20.4% | 3% | 8.1% | 11.1% |
| TOL-soluble fraction Mp | 18000 | 15600 | 14400 | 13700 | 11500 | 13100 | 18800 | 14000 |
| TOL-soluble fration 100,000 or less | 70% | 77% | 91% | 87% | 58% | 92% | 72% | 88% |
| TOL B/THF A | 0.2 | 0.19 | 0.29 | 0.36 | 0.4 | 0.12 | 0.2 | 0.37 |

TABLE 4-continued

| | Physical properties of the toner | | | | | | |
|---|---|---|---|---|---|---|---|
| Toner No. | Example 9<br>9 | Comparative Example 1<br>10 | Comparative Example 2<br>11 | Comparative Example 3<br>12 | Comparative Example 4<br>13 | Comparative Example 5<br>14 | Comparative Example 6<br>15 |
| Styrene/acryl resin (1) | C-4 | C-4 | C-5 | C-6 | C-7 | C-6 | C-7 |
| Diene resin (2) | Present | Absent | Present | Absent | Absent | Present | Absent |
| Mixing ratio of resin ((1)/(2)) | 80/20 | — | 50/50 | — | — | 80/20 | — |
| Charge control agent | 3 | 1 | 1 | 1 | 2 | 2 | 3 |
| Wax | b | a | a/c | c | c | b | a |
| Magnetic iron oxide particles | Carbon black | Plural nuclei | Spherical | Plural nuclei | Plural nuclei | Spherical | Carbon black |
| Vent port in upper part of kneading member | Opened | Closed | Closed | Closed | Closed | Closed | Closed |
| Temperature of resin | 160° C. | 200° C. | 120° C. | 190° C. | 120° C. | 190° C. | 160° C. |
| DSC maximum endothermic peak temperature (° C.) | 103° C. | 74° C. | 75° C. | 102° C. | 101° C. | 103° C. | 74° C. |
| THF-insoluble fraction A (% by mass) | 49% | 52% | 15% | 52% | 22.5% | 60% | 24% |
| THF-soluble fraction MP | 9000 | 9000 | 124000 | 8800 | 15600 | 9000 | 16000 |
| THF-soluble fraction 100,000% or less | 82% | 68% | 80% | 54% | 52% | 40% | 60% |
| TOL-insoluble fraction B (% by mass) | 14% | 30% | 1% | 3% | 14.4% | 2.5% | 15% |
| TOL-soluble fraction Mp | 16000 | 20000 | 13300 | 11000 | 22000 | 31000 | 31000 |
| TOL-soluble fration 100,000 or less | 62% | 40% | 78% | 33% | 30% | 25% | 45% |
| TOL B/THF A | 0.28 | 0.58 | 0.07 | 0.06 | 0.64 | 0.04 | 0.62 |

In the table, the term "plural nuclei" found in the column of the magnetic iron oxide particles means magnetic iron oxide particles in the shape of crystals grown from plural particle nuclei such that smaller particle nuclei are formed on parental particles and undergo crystal growth. In the same column, the term "carbon black" means that carbon black is used in stead of magnetic iron oxide particles.

[Evaluation Method]

Toner No. 1 was subjected to a test of continuously printing 200,000 sheets using a commercially available copier (IR-105, manufactured by Canon, Inc.), which was modified to have a printing speed 1.5 times as high as usual, with a test chart of 4% print ratio under circumstances of 23° C. and 5% RH, 23° C. and 60% RH, and 32° C. and 80% RH. Furthermore, in the IR105, a heat roller fixing assembly was equipped and used as a fixing assembly. Such an assembly was removed outside and modified to be able to operate independently from the copier and to be optionally adjustable with respect to a fixing roller temperature, process speed, and pressure force. Using such an external fixing assembly, the toner was evaluated for fixing ability, anti-offset ability, and OHT fixing ability (Evaluation A). Furthermore, from a commercially available LPB printer (LaserJet 4300, manufactured by Hewlett-Packard Development Company) in which a fixing assembly used was constructed of a pressure member that fixed a recording material on a heating body via a film, the fixing assembly was removed outside. Then, the fixing assembly was modified to be able to operate independently from the printer, to be optionally adjustable to a desired fixing film temperature, and to have a process speed of 350 mm/sec. Subsequently, the modified fixing assembly was provided as an external fixing assembly (low-power consumption fixing assembly) to evaluate the toner for fixing ability, anti-offset ability, and OHT fixing ability (Evaluation B). The results were listed in Tables 5 to 8 below, respectively. In addition, the concrete methods for evaluation are described below.

Fixing Ability

In Evaluation A, a fixed image was obtained from two kinds of unfixed images (solid and halftone) by feeding a sheet of paper (90 g/m$^2$) through the fixing assembly heated at 150° C. under the conditions of: a process speed of 600 mm/sec and an applied pressure force of 30 kgf/cm$^2$. Then, the resulting image was applied with a load of 50 g/cm$^2$. The fixed image was subjected to sliding friction with lens-cleaning paper.

The degree of reduction in image density (%) before and after the sliding friction was evaluated. The results are classified as follows.

A: 10% or less

B: more than 10% but 20% or less

C: more than 20%

In Evaluation B, the same evaluation was performed as that of Evaluation A, except that 75 g/m$^2$ paper was used and fed through the fixing assembly heated at 150° C. to fix two kinds of unfixed images (solid and halftone) on the paper.

OHT Fixing Ability

In Evaluation A, a fixed image was obtained from an unfixed solid image by feeding a sheet of paper (90 g/m$^2$) through the fixing assembly heated at 180° C. under the conditions of: a process speed of 600 mm/sec and an applied pressure force of 30 kgf/cm$^2$. Then, the resulting image was applied with a load of 50 g/cm$^2$.

The fixed image was subjected to sliding friction with lens-cleaning paper. The degree of reduction in image density (%) before and after the sliding friction was evaluated. The results are classified as follows.

A: 10% or less

B: more than 10% but 20% or less

C: more than 20%

In Evaluation B, the same evaluation was performed as that of Evaluation A, except that 75 g/m$^2$ paper was used and fed through the fixing assembly heated at 180° C. to fix an unfixed solid image on the paper.

Anti-Offset Ability

In Evaluation A, under the conditions of a process speed of 50 mm/sec and an applied pressure force of 50 kgf/cm$^2$, an unfixed image of about 5% in image area ratio was fixed on 50 g/m$^2$ paper by feeding the paper through a fixing assembly heated at 240° C. to obtain a fixed image. Then, the resulting image was evaluated according to the following classification.

A: Good

B: Slightly stained

C: Stained to affect an image

In Evaluation B, evaluation was conducted under the same conditions as those of Evaluation A, except that 50 g/m$^2$ paper was fed through a fixing assembly heated at 240° C. to obtain a fixed image from an unfixed solid image.

Image Evaluation

An image density was measured using a 5×5 (mm) image portion of the resulting image by reflection density measurement by using a Macbeth density meter (manufactured by Macbeth Co., Ltd.) with a SPI filter. Fogging was evaluated using a reflection density meter (Reflect meter model TC-6DS, manufactured by Tokyo Denshoku Co., Ltd.). A worst reflection density on a white section after the image formation was defined as Ds, an average reflection density on a transfer material before the image formation was defined as Dr, and Ds—Dr was defined as the amount of fogging. Smaller densities indicate that the toner is more excellent in ability of preventing the generation of fogging. The evaluation about dot reproductivity was conducted as follows. An image with isolated 100 dots was formed and then the evaluation was performed to confirm how many dots were visually recognized among these 100 dots. More excellent image quality corresponds to a larger number of dots reproduced. Those evaluations were conducted on the initial printing and at the time of printing the 200,000th sheet (i.e., after lasting 200,000 sheets).

Examples 2 to 6

Toners Nos. 2 to 6 were prepared by controlling the retaining time at the time of kneading so that the resin temperatures described in Table 4 were attained just as in the case with Example 1 with the formulations described in Table 4. Physical properties of Toners Nos. 2 to 6 thus obtained are listed in table 4 and their evaluation results obtained just as in the case with Example 1 are also listed in Tables 5 to 8, respectively.

Comparative Examples 1 to 3

Toners Nos. 10 to 12 were prepared by controlling the retaining time at the time of kneading so that the resin temperatures described in Table 4 were attained just as in the case with Example 1 with the formulations described in Table 4, except that the vent port in the kneading member was closed. Physical properties of Toners Nos. 10 to 12 thus obtained are listed in table 4 and their evaluation results obtained just as in the case with Example 1 are also listed in Tables 5 to 8, respectively.

TABLE 5

Evaluation results for fixing ability

| | Solid fixing ability | | Halftone fixing ability | | OHT fixing ability | | Anti-offset ability | |
|---|---|---|---|---|---|---|---|---|
| | Heat roller fixing assembly | Low-power consumption fixing assembly | Heat roller fixing assembly | Low-power consumption fixing assembly | Heat roller fixing assembly | Low-power consumption fixing assembly | Heat roller fixing assembly | Low-power consumption fixing assembly |
| Example 1 | A (3%) | A (5%) | A (6%) | A (7%) | A (5%) | A (6%) | A | A |
| Example 2 | A (5%) | A (7%) | A (7%) | A (7%) | A (6%) | A (7%) | A | A |
| Example 3 | A (8%) | A (9%) | A (9%) | B (11%) | B (12%) | B (13%) | A | A |
| Example 4 | A (9%) | B (11%) | B (12%) | B (12%) | A (9%) | B (12%) | A | B |
| Example 5 | A (10%) | B (13%) | B (11%) | B (14%) | A (10%) | B (12%) | B | B |
| Example 6 | A (6%) | A (8%) | A (8%) | A (8%) | B (13%) | B (14%) | B | B |
| Comparative Example 1 | C (23%) | C (25%) | C (24%) | C (30%) | B (18%) | B (17%) | A | C |
| Comparative Example 2 | B (15%) | C (22%) | B (18%) | C (25%) | C (25%) | C (28%) | C | C |
| Comparative Example 3 | C (35%) | C (40%) | C (33%) | C (38%) | C (34%) | C (36%) | B | B |

TABLE 6

Evaluation results in a high-temperature and high-humidity (32° C., 80% RH) environment

| | Initial | | | After lasting 200,000 sheets | | |
|---|---|---|---|---|---|---|
| | Density | Fogging | Dot reproductivity | Density | Fogging | Dot reproductivity |
| Example 1 | 1.45 | 0.9 | 100 | 1.40 | 1.1 | 92 |
| Example 2 | 1.41 | 0.5 | 99 | 1.40 | 0.9 | 96 |
| Example 3 | 1.40 | 1.0 | 97 | 1.38 | 1.1 | 91 |
| Example 4 | 1.41 | 0.9 | 96 | 1.32 | 1.2 | 88 |
| Example 5 | 1.40 | 1.1 | 95 | 1.29 | 1.5 | 85 |

TABLE 6-continued

| Evaluation results in a high-temperature and high-humidity (32° C., 80% RH) environment | | | | | | |
|---|---|---|---|---|---|---|
| | Initial | | | After lasting 200,000 sheets | | |
| | Density | Fogging | Dot reproductivity | Density | Fogging | Dot reproductivity |
| Example 6 | 1.44 | 0.8 | 96 | 1.28 | 0.9 | 80 |
| Comparative Example 1 | 1.37 | 1.1 | 88 | 1.10 | 1.5 | 70 |
| Comparative Example 2 | 1.35 | 1.5 | 96 | 1.22 | 2.0 | 65 |
| Comparative Example 3 | 1.39 | 1.8 | 78 | 1.25 | 2.6 | 50 |

TABLE 7

| Evaluation results in a normal-temperature and normal-humidity (23° C., 60% RH) environment | | | | | | |
|---|---|---|---|---|---|---|
| | Initial | | | After lasting 200,000 sheets | | |
| | Density | Fogging | Dot reproductivity | Density | Fogging | Dot reproductivity |
| Example 1 | 1.45 | 1.0 | 100 | 1.45 | 1.1 | 99 |
| Example 2 | 1.40 | 0.8 | 99 | 1.39 | 0.9 | 95 |
| Example 3 | 1.41 | 1.0 | 98 | 1.37 | 1.0 | 95 |
| Example 4 | 1.40 | 1.0 | 97 | 1.35 | 2.0 | 90 |
| Example 5 | 1.39 | 1.1 | 96 | 1.30 | 1.9 | 90 |
| Example 6 | 1.43 | 1.8 | 96 | 1.35 | 2.2 | 85 |
| Comparative Example 1 | 1.44 | 2.0 | 96 | 1.22 | 2.8 | 88 |
| Comparative Example 2 | 1.38 | 2.5 | 95 | 1.15 | 3.2 | 65 |
| Comparative Example 3 | 1.35 | 2.4 | 88 | 1.33 | 4.5 | 55 |

TABLE 8

| Evaluation results in a normal-temperature and low-humidity (23° C., 5% RH) environment | | | | | | |
|---|---|---|---|---|---|---|
| | Initial | | | After lasting 200,000 sheets | | |
| | Density | Fogging | Dot reproductivity | Density | Fogging | Dot reproductivity |
| Example 1 | 1.46 | 1.1 | 99 | 1.45 | 1.0 | 99 |
| Example 2 | 1.41 | 1.0 | 99 | 1.40 | 1.2 | 96 |
| Example 3 | 1.40 | 1.2 | 99 | 1.39 | 1.5 | 98 |
| Example 4 | 1.39 | 1.5 | 96 | 1.37 | 1.6 | 90 |
| Example 5 | 1.40 | 1.6 | 92 | 1.35 | 2.0 | 85 |
| Example 6 | 1.43 | 1.9 | 95 | 1.38 | 2.4 | 83 |
| Comparative Example 1 | 1.43 | 2.2 | 95 | 1.25 | 3.5 | 84 |
| Comparative Example 2 | 1.39 | 2.6 | 96 | 1.21 | 4.0 | 70 |
| Comparative Example 3 | 1.38 | 2.4 | 80 | 1.34 | 5.1 | 62 |

Example 7

The materials listed below were premixed using a Henschel mixer and then melt-kneaded using a biaxial kneading extruder (kneader). At this time, a vent port in a kneading member of the kneader was opened and a time period for retaining the kneaded resin was then controlled so that the temperature of the kneaded resin was adjusted to 150° C.

Styrene/acryl resin C-1: 80 parts by mass

Diene resin (styrene-butadiene copolymer):

20 parts by mass (Styrene:butadiene=85:15 (mass ratio), peak molecular weight=25,000, Mw=270,000, Mn=20,000)

Magnetic iron oxide particles (plural nuclei, number average particle size=0.21 μm):

95 parts by mass

Wax a: 4 parts by mass

Wax b: 2 parts by mass

Charge control agent B (azo iron complex):

2 parts by mass (but, in the above materials, the charge control agent B is represented by the structural formula (B) below).

(B)

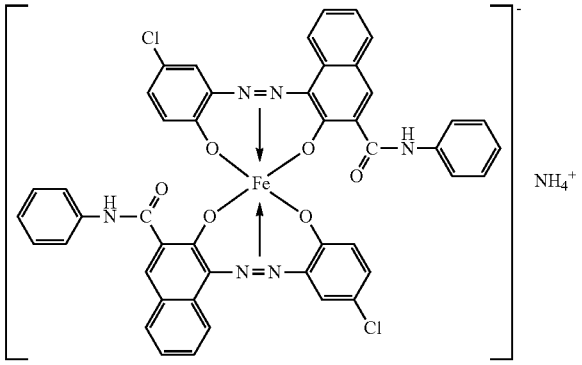

The resulting kneaded product was cooled and roughly pulverized with a hammer mill and then finely pulverized with a jet-stream pulverizing mill. The resulting pulverized powder was classified using a fractionating classifier based on Coanda effect to obtain toner particles with a weight average particle size of 6.5 μm. Subsequently, 1.2 parts by mass of hydrophobic silica fine powder having a methanol wettability of 80% and a BET specific surface area of 120 $m^2/g$, which had been subjected to a hydrophobic treatment with 15% by mass of hexamethyldisilazane and 15% by mass of dimethyl silicone, and 1.0 part by mass of strontium titanate were externally added to 100 parts by mass of the toner particles and then the whole was filtrated through a 150-μm pore size mesh filter, thereby obtaining Toner No. 7. The internal formulation and physical properties of the toner are listed in table 4.

Toner 7 as prepared above was evaluated for fixing ability, anti-offset ability, and OHT fixing ability by the same ways as those of Example 1.

Toner No. 7 was subjected to a test of continuously printing 10,000 sheets using a commercially available LPB printer (LaserJet 4300, manufactured by Hewlett-Packard Development Company), which was modified to have a printing speed 1.5 times as high as usual, with a test chart of 4% print ratio under circumstances of 15° C. and 10% RH, 23° C. and 60% RH, and 32° C. and 80% RH. The resulting images were evaluated at the time of initial printing and at the time of lasting 10,000 sheets by the same way as that of Example 1. The results are listed in Tables 9 to 12, respectively.

Example 8

Toner No. 8 was prepared using the formula described in Table 4 by the same way as that of Example 7 by controlling the retaining time at the kneading to attain the resin temperature described in Table 4. The physical properties of the toner obtained are listed in Table 4 and the results obtained by subjecting the toner to the same evaluation tests as those of Example 7 are listed in Tables 9 to 12, respectively.

Comparative Examples 4 to 5

Toners Nos. 13 and 14 were prepared using the formulations described in Table 4 by the same way as that of Example 7 by controlling the retaining time at the kneading to attain the resin temperatures described in Table 4 while closing the vent port in the kneading member. The physical properties of the toners obtained are listed in Table 4 and the results obtained by subjecting the toners to the same evaluation tests as those of Example 7 are listed in Tables 9 to 12, respectively.

TABLE 9

Evaluation results for fixing ability

| | Solid fixing ability | | Halftone fixing ability | | OHT fixing ability | | Anti-offset ability | |
|---|---|---|---|---|---|---|---|---|
| | Heat roller fixing assembly | Low-power consumption fixing assembly | Heat roller fixing assembly | Low-power consumption fixing assembly | Heat roller fixing assembly | Low-power consumption fixing assembly | Heat roller fixing assembly | Low-power consumption fixing assembly |
| Example 7 | A (4%) | A (5%) | A (7%) | A (8%) | A (6%) | A (8%) | A | A |
| Example 8 | A (7%) | B (11%) | B (11%) | B (13%) | A (8%) | B (12%) | A | B |
| Comparative Example 4 | C (45%) | C (50%) | C (43%) | C (46%) | B (19%) | C (25%) | B | B |
| Comparative Example 5 | C (35%) | C (35%) | C (40%) | C (35%) | C (25%) | C (30%) | B | B |

TABLE 10

Evaluation results in a high-temperature and high-humidity (32° C., 80% RH) environment

| | Initial | | | After lasting 10,000 sheets | | |
|---|---|---|---|---|---|---|
| | Density | Fogging | Dot reproductivity | Density | Fogging | Dot reproductivity |
| Example 7 | 1.44 | 0.9 | 99 | 1.40 | 1.2 | 91 |
| Example 8 | 1.40 | 1.1 | 97 | 1.35 | 1.5 | 90 |
| Comparative Example 4 | 1.33 | 1.9 | 80 | 1.10 | 2.5 | 65 |
| Comparative Example 5 | 1.40 | 2.1 | 96 | 1.05 | 3.0 | 71 |

TABLE 11

Evaluation results in a normal-temperature and normal-humidity (23° C., 60% RH) environment

| | Initial | | | After lasting 10,000 sheets | | |
|---|---|---|---|---|---|---|
| | Density | Fogging | Dot reproductivity | Density | Fogging | Dot reproductivity |
| Example 7 | 1.43 | 1.1 | 99 | 1.43 | 1.2 | 98 |
| Example 8 | 1.41 | 1.3 | 97 | 1.37 | 1.8 | 89 |
| Comparative Example 4 | 1.38 | 1.1 | 96 | 1.25 | 2.9 | 80 |
| Comparative Example 5 | 1.39 | 1.2 | 97 | 1.33 | 2.8 | 76 |

TABLE 12

Evaluation results in a low-temperature and low-humidity (15° C., 10% RH) environment

| | Initial | | | After lasting 10,000 sheets | | |
|---|---|---|---|---|---|---|
| | Density | Fogging | Dot reproductivity | Density | Fogging | Dot reproductivity |
| Example 7 | 1.41 | 1.5 | 98 | 1.40 | 1.8 | 96 |
| Example 8 | 1.42 | 1.9 | 99 | 1.37 | 2.2 | 91 |
| Comparative Example 4 | 1.33 | 2.9 | 78 | 1.31 | 3.5 | 65 |
| Comparative Example 5 | 1.38 | 1.9 | 97 | 1.22 | 2.9 | 81 |

Example 9

The materials listed below were premixed using a Henschel mixer and then melt-kneaded using a biaxial kneading extruder (kneader). At this time, a vent port in a kneading member of the kneader was opened and a time period for retaining the kneaded resin was then controlled so that the temperature of the kneaded resin was adjusted to 160° C.

Styrene/acryl resin C-4: 80 parts by mass

Diene resin (styrene-butadiene copolymer): 20 parts by mass (Styrene:butadiene=85:15 (mass ratio), peak molecular weight=25,000, Mw=270,000, Mn=20,000)

Carbon black: 5 parts by mass

Wax b: 4 parts by mass

Charge control agent C (aluminum salicylate compound): 2 parts by mass (in the above materials, the charge control agent C is represented by the structural formula (C) below).

(C)

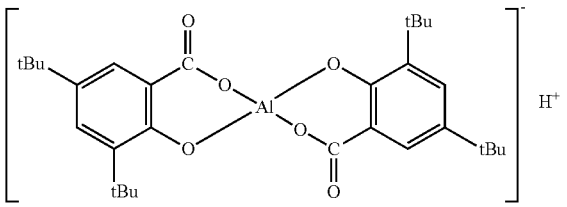

The resulting kneaded product was cooled and roughly pulverized with a hammer mill and then finely pulverized with a jet-stream pulverizing mill. The resulting pulverized powder was classified using a fractionating classifier based on Coanda effect to obtain toner particles with a weight average particle size of 6.5 μm. Subsequently, 1.2 parts by mass of hydrophobic silica fine powder (methanol wettability=80%, BET specific surface area=120 $m^2/g$), which had been subjected to a hydrophobic treatment with 15% by mass of hexamethyldisilazane and 15% by mass of dimethyl silicone, and 0.2 part by mass of titanium oxide fine particle having a primary particle size of 50 nm, which had been subjected to a surface treatment with isobutyl trimethoxysilane, were externally added to 100 parts by mass of the toner particles. Then, the whole was filtrated through a 150-μm pore size mesh filter, thereby obtaining Toner No. 9. The internal formulation and physical properties of the toner are listed in table 4.

Toner No. 9 was subjected to a test of continuously printing 3,000 sheets using a commercially available LPB printer (LBP-2510, manufactured by Canon, Inc.), which was modified to have a printing speed 1.5 times as high as usual, with a test chart of 4% print ratio under circumstances of 15° C. and 10% RH, 23° C. and 60% RH, and 32° C. and 80% RH. The resulting images were evaluated at the time of initial printing and at the time of lasting 3,000 sheets by the same way as that of Example 1. The results are listed in Tables 13 to 15, respectively.

Comparative Example 6

Toner No. 15 was prepared using the formulation described in Table 4 and 1 by the same way as that of Example 9 by controlling the retaining time at the kneading to attain the resin temperature described in Table 4 while closing the vent port in the kneading member. The physical properties of the toner obtained are listed in Table 4 and the results obtained by subjecting the toner to the same evaluation tests as those of Example 9 are listed in Tables 13 to 15, respectively.

TABLE 13

Evaluation results in a high-temperature and high-humidity (32° C., 80% RH) environment

| | Initial | | After lasting 3,000 sheets | |
|---|---|---|---|---|
| | Density | Fogging | Density | Fogging |
| Example 9 | 1.41 | 0.9 | 1.33 | 1.5 |
| Comparative Example 6 | 1.33 | 1.9 | 0.95 | 3.8 |

TABLE 14

Evaluation results in a normal-temperature and normal-humidity (23° C., 60% RH) environment

| | Initial | | After lasting 3,000 sheets | |
|---|---|---|---|---|
| | Density | Fogging | Density | Fogging |
| Example 9 | 1.43 | 1.1 | 1.38 | 1.4 |
| Comparative Example 6 | 1.36 | 2.0 | 1.20 | 2.5 |

TABLE 15

Evaluation results in a low-temperature and low-humidity (15° C., 10% RH) environment

| | Initial | | After lasting 3,000 sheets | |
|---|---|---|---|---|
| | Density | Fogging | Density | Fogging |
| Example 9 | 1.38 | 1.9 | 1.35 | 2.1 |
| Comparative Example 6 | 1.37 | 3.8 | 1.17 | 3.9 |

As described above, according to the present invention, there is provided: a toner which allows fixation at low temperatures, which is excellent in anti-offset ability, and which provides a high quality image at high and low humidities in a stable manner without causing any image defect over time.

This application claims priority from Japanese Patent Application No. 2003-346896 filed Oct. 6, 2003, which is hereby incorporated by reference herein.

What is claimed is:

1. A process for manufacturing a toner, comprising:

(a) preparing a carboxyl group-containing vinyl resin by initially synthesizing a vinyl resin and thereafter, adding a monomer containing a carboxyl group to the vinyl resin, thereby synthesizing the carboxyl group-containing vinyl resin;

(b) preparing a glycidyl group-containing vinyl resin by initially synthesizing a vinyl resin and thereafter, adding a monomer containing a glycidyl group to the vinyl resin, thereby synthesizing the glycidyl group-containing vinyl resin;

(c) reacting the carboxyl group-containing vinyl resin with the glycidyl group-containing vinyl resin to obtain a styrene/acryl resin;

(d) melt-kneading the styrene/acryl resin and a colorant;

(e) pulverizing the resulting kneaded product; and (g) classifying the resulting pulverized product, wherein:

(i) an obtained toner has a binder resin and a colorant, (ii) the binder resin in the toner contains 60% by mass or more of the styrene/acryl resin;

(iii) the binder resin in the toner contains a THF-insoluble fraction A which is an extraction residue obtained by carrying out Soxhlet extraction with tetrahydrofuran (THF) for 16 hours;

(iv) the THF-insoluble fraction A contains a TOL-insoluble fraction B which is an extraction residue obtained by carrying out Soxhlet extraction with toluene (TOL) for 16 hours;

(v) a mass ratio (B/A) between the THF-insoluble fraction A and the TOL-insoluble fraction B is in a range of $0.1 \leqq B/A \leqq 0.5$.

* * * * *